US010750923B2

(12) United States Patent
Delangue

(10) Patent No.: US 10,750,923 B2
(45) Date of Patent: Aug. 25, 2020

(54) RINSING DEVICE

(71) Applicant: SPONTEX S.A.S., Colombes (FR)

(72) Inventor: Fabien Delangue, Bagnolet (FR)

(73) Assignee: Spontex S.A.S. (FR)

( * ) Notice: Subject to any disclaimer, the term of this patent is extended or adjusted under 35 U.S.C. 154(b) by 4 days.

(21) Appl. No.: 15/663,183

(22) Filed: Jul. 28, 2017

(65) Prior Publication Data

US 2018/0028040 A1 Feb. 1, 2018

(30) Foreign Application Priority Data

Jul. 29, 2016 (FR) ..... 16 57394

(51) Int. Cl.

| | |
|---|---|
| ***A47L 13/58*** | (2006.01) |
| ***A46B 17/06*** | (2006.01) |
| ***B08B 3/02*** | (2006.01) |
| ***B08B 1/00*** | (2006.01) |
| ***A47L 13/59*** | (2006.01) |
| ***A47L 13/60*** | (2006.01) |

(52) U.S. Cl.

CPC ..... *A47L 13/58* (2013.01); *A46B 17/06* (2013.01); *A47L 13/59* (2013.01); *A47L 13/60* (2013.01); *B08B 1/007* (2013.01); *B08B 3/02* (2013.01)

(58) Field of Classification Search

CPC ..... B67D 7/60; B67D 7/205; A47L 13/58; A47L 13/59; A47L 13/60; A47L 13/142; A47L 13/144; A46B 17/06; A46B 17/065; B08B 1/007; F04B 9/14

See application file for complete search history.

(56) References Cited

U.S. PATENT DOCUMENTS

| | | | | |
|---|---|---|---|---|
| 3,134,544 | A | 5/1964 | Copley | |
| 3,605,160 | A * | 9/1971 | Maurer | A46B 17/06 15/104.92 |
| 3,990,611 | A * | 11/1976 | Sojka | A47K 5/1205 222/135 |
| 4,888,847 | A | 12/1989 | Montijo | |
| 4,983,221 | A * | 1/1991 | Kaiser | B08B 1/007 134/6 |

(Continued)

FOREIGN PATENT DOCUMENTS

| | | | |
|---|---|---|---|
| CN | 201268462 | Y | 7/2009 |
| CN | 201504794 | U | 6/2010 |

(Continued)

OTHER PUBLICATIONS

Machine Translation of Salmon, EP 0781524 A2, Jul. 1997. (Year: 1997).*

(Continued)

*Primary Examiner* — David G Cormier

(74) *Attorney, Agent, or Firm* — Eversheds Sutherland (US) LLP

(57) ABSTRACT

A rinsing device for boosting the quality of the rinsing of a cleaning device to facilitate and improve the cleanness of surface cleaning, the rinsing device comprising a first tank (41) provided to collect wastewater coming from the cleaning device, a second tank (42) provided to store clean water, and a mechanical pumping device (15, 50) configured to pump clean water coming from the second tank (42) to wet the cleaning device.

20 Claims, 19 Drawing Sheets

(56) References Cited

U.S. PATENT DOCUMENTS

| | | | | |
|---|---|---|---|---|
| 5,471,726 | A * | 12/1995 | Kaiser | B08B 1/007 15/1 |
| 8,556,131 | B2 | 10/2013 | Decottignies et al. | |
| 9,226,640 | B1 | 1/2016 | Wulff | |
| 2007/0039117 | A1 | 2/2007 | Palmer | |
| 2007/0113418 | A1 | 5/2007 | Palmer | |
| 2007/0226942 | A1 | 10/2007 | Damrath et al. | |
| 2012/0298148 | A1* | 11/2012 | McLain | B24B 53/007 134/33 |

FOREIGN PATENT DOCUMENTS

| | | | |
|---|---|---|---|
| CN | 102019947 | A | 4/2011 |
| CN | 201879645 | U | 6/2011 |
| CN | 203186772 | U | 9/2013 |
| CN | 204797766 | U | 11/2015 |
| DE | 29700710 | U1 | 6/1997 |
| DE | 19648956 | A1 | 6/1998 |
| DE | 10065373 | A1 | 7/2002 |
| DE | 202016001397 | U1 | 5/2016 |
| EP | 0781524 | A2 | 7/1997 |
| EP | 1219226 | A1 | 7/2002 |
| EP | 1970270 | A1 | 9/2008 |
| EP | 2875769 | A1 | 5/2015 |
| ES | 2442440 | | 2/2014 |
| GB | 1520839 | | 8/1978 |
| WO | 02/00089 | A1 | 1/2002 |
| WO | 2004/105570 | A1 | 12/2004 |
| WO | 2005/079468 | A2 | 9/2005 |
| WO | 2016083281 | A1 | 6/2016 |

OTHER PUBLICATIONS

FR Patent App. 1657394, Preliminary Search Report, dated Nov. 13, 2017 (6 pages).

* cited by examiner

RINSING DEVICE

FIELD OF THE INVENTION

The present explanation relates to a rinsing device for boosting the quality of the rinsing of a cleaning device so as to facilitate and improve the cleanness of surface cleaning.

This type of device, for individual or professional usage, can be used to improve rinsing of any type of cleaning devices, and especially those of the wet brush type such as mop, towelette or fringe brushes, to cite a few examples.

PRIOR ART

For many years now, many types of wet brushes have been proposed to make floor cleaning easier. All these brushes have produced considerable gains in terms of cleaning quality and ease of use.

However, all these brushes also raise rinsing and wringing problems, with proper rinsing and proper wringing being paramount to maintain the cleaning quality over time. In fact, during cleaning, the cleaning head of the brush is covered in dirt which has to be eliminated during rinsing so as not to risk depositing it back on the surface to be cleaned later. Also, some brushes can find it difficult to pick up fresh dirt if their cleaning head is already largely covered in dirt.

Therefore, many wringing devices have been proposed: some are mounted within a bucket, others are placed directly on the brush. But common to all is that they use a single tank of cleaning liquid for rinsing the brush head: the latter is soaked in the cleaning liquid then wrung out by means of the wringing device. However, irrespective of the efficacy of the wringing device, the cleaning liquid is progressively contaminated by the dirt released by the cleaning head: so the quality of rinsing degrades quickly, and dirt can be deposited back on the brush head when the latter is dipped in the cleaning liquid tank. As a consequence, hygiene and quality of cleaning end up becoming degraded, which mechanically prolongs the cleaning time.

There is therefore a real need for a rinsing device for boosting the quality of the rinsing of a cleaning device so as to facilitate and improve the cleanness of surface cleaning and which is devoid, at least in part, of disadvantages inherent to the above known devices.

PRESENTATION OF THE INVENTION

The present explanation relates to a rinsing device for a cleaning device, comprising a first tank provided to collect wastewater coming from the cleaning device, a second tank provided to store clean water, and a mechanical pumping device, configured to pump clean water coming from the second tank to wet the cleaning device.

So because of such a rinsing device, it is possible to collect wastewater coming from the cleaning device in a dedicated tank and reinject clean water into the cleaning device, coming from a separate tank. Therefore, dirt present on the cleaning device is released and discharged into the wastewater tank and does not contaminate the tank of clean water: the cleaning device is therefore rinsed with water which stays clean throughout cleaning.

As a consequence, the cleaning device is restored to a high state of cleanness on completion of each of the rinsing cycles such that the cleanness and quality of the cleaning remain high throughout cleaning.

This rinsing device is also more ecological since it reduces the quantities of water and detergent used, and the head of the cleaning device no longer needs to be fully immersed in the cleaning liquid. Such a configuration also brings reduced bulk.

In the present explanation the terms "axial", "radial", "tangential", "internal" "external" and their derivatives are defined relative to the main axis of the rinsing device; "axial plane" means a plane passing through the main axis of the rinsing device and "radial plane" means a plane perpendicular to this main axis; finally, the terms "upstream" and "downstream" are defined relative to clean water circulation in the rinsing device. Also, "clean water" means any cleaning liquid essentially comprising water, optionally mixed with a detergent or other cleaning product. The pumping device can be any type: it can especially be of rectilinear type, a piston for example, or rotary type, centrifuge or wheel for example.

In some embodiments, the pumping device is configured to be activated by means of the cleaning device. The rinsing device is accordingly very easy to use: the user can hold the cleaning device in his hand, avoiding hazardous handling and risking dropping the cleaning device, and is not restricted for example by activating a particular lever or pedal. Also, the rinsing device can be activated from a distance, which ensures more hygienic use, the user not being restricted in handling the rinsing device or the cleaning head of the cleaning device directly; this further reduces the risk of the user being splashed during rinsing.

In some embodiments, the pumping device is configured to pump clean water when an activating member of the pumping device is driven in rotation. Driving the activating member in rotation can be done in different ways: the rinsing device can comprise a motor or a manual pedal drive for example; the rotation movement can also be brought from the exterior of the rinsing device, for example by means of the cleaning device or another tool.

In some embodiments, the pumping device is configured to pump clean water when an activating member of the pumping device is driven in rotation by the cleaning device. Such a configuration is particularly adapted while the cleaning device is fitted with a mechanism for driving in rotation, especially of the type enabling wringing by centrifuge. In fact, in such a case, the pumping device is triggered by activation of the wringing device of the cleaning device, without the need to provide a separate actuator: in a single gesture the user can start both wringing and clean water pumping.

In some embodiments, the pumping device is of rotary type.

In some embodiments, the pumping device comprises an Archimedes screw. Such a configuration is particularly effective for lifting water, substantially vertically, from a tank to a level located above the tank.

In some embodiments, the rinsing device comprises a plate provided to enter in contact with the cleaning device. Such a plate offers a large surface for easy cooperation with the rinsing device.

In some embodiments, the pumping device is configured to have clean water flow along the plate. The cleaning device can soak clean water when in contact with the surface of the plate.

In some embodiments, the second tank comprises a lid and the plate is formed by this lid.

In some embodiments, the surface of the plate is inclined towards the exterior and can especially be conical or bulging. In this way, clean excess water can be discharged from the surface of the plate, preferably towards the wastewater tank: this avoids leaving stagnant water, possibly soiled by the brush, on the surface of the plate.

In some embodiments, the rinsing device comprises a connecting member configured to cooperate with a connecting member of the cleaning device. This indexes the position of the cleaning device on the rinsing device for easier use of the latter. These connecting members can also block the cleaning device to prevent it from moving during rinsing. They can also enable transmission of rotational torque from the cleaning device to the rinsing device.

In some embodiments, the connecting member is rotationally mounted relative to the plate. This allows relative rotation movement between the cleaning device and the rinsing device, which can facilitate wringing of the cleaning device.

In some embodiments, the rinsing device comprises a lift mechanism configured to shift the connecting member between at least one lower level and one upper level. So when the connecting member is at the lower level, the cleaning device is in contact with the clean water brought by the pumping device and can therefore be rinsed; inversely, when the connecting member is at the upper level, the cleaning device is at a distance from the clean water and can be wrung out without being wet again.

In some embodiments, the lift mechanism is configured such that when the connecting member is positioned at the lower level, the cleaning device brushes the surface of the plate. The passage of clean water from the surface of the plate to the cleaning device is made easier thereby.

In some embodiments, at least two centimeters, and preferably three centimeters, separate the upper level from the lower level. In this way, the risk of the cleaning device continuing to be wet in the upper position is reduced, even when the cleaning device has fringes hanging in the direction of the plate. The cleaning device can be wrung out effectively.

In some embodiments, the lift mechanism comprises a cam surface, secured in translation to the plate, and at least one follower element, secured in translation to the connecting member. In the present explanation, it is considered that two pieces are "secured in translation" when displacement of one piece according to a translation movement solidly causes displacement of the other piece according to the same translation movement; however, these two pieces are free to turn independently of each other, one for example able to be rotationally mounted relative to the other.

In other embodiments, the cam surface is secured in translation to the connecting member whereas the follower element is secured in translation to the plate.

In some embodiments, the lift mechanism is configured to comprise at least one lower stable position, wherein the connecting member is at the lower level, and at least one upper stable position, wherein the connecting member is at the upper level.

In some embodiments, the lift mechanism comprises a return element configured to return the follower element to a stable position, the follower element able to move from a stable position to the following by exerting a preset force against the return force of the return element. Therefore, the user needs only to push the cleaning device downwards to move from a stable position to the following one. In particular, when the cleaning device comprises a device for driving in rotation transforming a vertical movement of a sleeve or of the cleaning device itself into a rotation movement, simple activation of this driving device can enable moving from a stable position to the following one.

In other embodiments, the elevation device has no return element. In such a case, gravity can define stable positions: the user moves from one stable position to the other by lifting the cleaning device.

In some embodiments, the lift mechanism comprises several lower successive stable positions. Preferably, it comprises at least three lower successive stable positions. In this way, the cleaning device remains long enough in its lower position to enable effective rinsing before rising to the upper position.

In some embodiments, the lift mechanism comprises at least one intermediate stable position in which the connecting member is at an intermediate level between the lower level and the upper level. In this way, the cleaning device does not rise suddenly and abruptly from the lower level to the upper level but passes through at least one intermediate level: the elevation movement is therefore progressive, and this avoids surprising the user. The risk of being splashed during elevation is also reduced.

In some embodiments, the lift mechanism is configured such that the force to be exerted against the return force of the return element to leave a stable upper position is greater, preferably at least twice as much, than the force to be exerted to leave a lower stable position. In this way, the risk of the cleaning device not moving from the upper position to the lower position involuntarily is reduced. In particular, when the cleaning device is fitted with a device for driving in actionable rotation by vertical out-and-back movements, it is possible to action the latter without needing to exceed this stronger preset force and therefore without going back down to the lower position: the user must thus voluntarily exert greater force to reach the following stable position to the chosen time. In this way, it is possible to perform as many wringing movements as needed by staying in the upper position, at a distance from the clean water.

In some embodiments, the rinsing device comprises a clutch mechanism configured to enable or prevent, according to a preset condition, transmission of rotation of the connecting member to the activating member. This leaves more freedom in managing clean water: in particular, this avoids pumping clean water, and therefore wasting the latter when this is unnecessary, in particular when the cleaning device is in the upper wringing position.

In some embodiments, the clutch mechanism is configured to enable the transmission of rotation from the connecting member to the activating member when the connecting member is at the lower level and to prevent this transmission when the connecting member is at the upper level.

In some embodiments, the connecting member comprises a finger engaging in a cavity of the activating member when the connecting member is at the lower level and exiting from the cavity of the activating member when the connecting member is at the upper level.

In some embodiments, the pumping device is configured to pump clean water when the cleaning device exerts pressure on the rinsing device, preferably on an activating member of the pumping device. The rinsing device is therefore very easy to use since it suffices to press against the rinsing device by means of the cleaning device to initiate a rinsing cycle.

In some embodiments, the pumping device comprises a compression chamber, a piston movable in the compression chamber between a rest position and a compression position, and a valve connecting the compression chamber to a discharge conduit. In this way, when the piston descends into the compression chamber, under the effect of the pressure from the cleaning device, the clean water contained in the compression chamber is compressed until it reaches the opening pressure of the valve: the valve opens and the clean water is discharged under pressure in the direction of the cleaning head via the discharge conduit.

In some embodiments, the pumping device comprises a spring exerting a return force on the piston. The pumping device resumes its initial state, ready for a new cycle, when the pressure exerted by the cleaning device is relaxed.

In some embodiments, the activating member is formed by the piston. The cleaning device can then exert pressure directly or indirectly on the piston to initiate a rinsing cycle.

In some embodiments, the valve is provided within the piston.

In some embodiments, the discharge conduit passes axially through the piston. Such a configuration, potentially axisymmetrical, makes the device easy to use.

In some embodiments, the second tank and the compression chamber are connected fluidically by a filling passage at least when the piston is in its rest position. In this way, the compression chamber can be filled with clean water so it can be discharged via the pumping device.

In some embodiments, the filling passage is calibrated so as to prohibit a reflux rate higher than 1 cl/s, preferably 0.5 cl/s, coming from the compression chamber. Such a reflux rate is sufficiently low, relative to the normal activation speed of the pumping device, to allow the rise in pressure in the compression chamber during descent of the piston and discharge of clean water during opening of the valve.

In some embodiments, at least one seal is installed in the filling passage. Such a seal limits the reflux rate in the filling passage and permits filling of the compression chamber.

In some embodiments, the filling passage comprises at least one narrowed section having a width of under 0.1 mm. Such a narrowed section limits the reflux rate in the filling passage and permits filling of the compression chamber.

In some embodiments, the width of this narrowed section decreases when the piston progresses towards its compression position.

In some embodiments, the filling passage is interrupted when the piston is in its compression position. In this way, the reflux rate is zero, or almost zero, when the piston descends into the compression chamber, making the rise in pressure easier.

In some embodiments, at least one check valve is installed in the filling passage.

In some embodiments, the plate is connected to the activating member of the pumping device. Pressing on the plate activates the pumping device.

In some embodiments, the plate comprises a plurality of nozzles connected to the pumping device, for example to the discharge conduit. It is possible to inject clean water directly into the cleaning head of the cleaning device, as closely as possible to the latter.

In some embodiments, the plate comprises at least one wringing member. It can especially be protrusions projecting onto the plate to exert wringing pressure on the cleaning head of the cleaning device.

In some embodiments, the plate comprises at least one wringing roller. Such a roller, rotationally mounted about an axis, exerts axial wringing pressure on the cleaning head of the cleaning device and reduces tangential friction force acting on the latter.

In some embodiments, the plate comprises at least one tuft of brush hairs and preferably rows of brush hairs. Such brush hairs make it easy to remove large amounts of dirt optionally present on the head of the cleaning device.

In some embodiments, at least one wringing member is movably mounted and preferably on a spring, on the plate. This makes for easy wringing and reduces tangential friction force acting on the head of the cleaning device.

In some embodiments, the plate is detachable. The term "detachable" means that it is possible to separate the plate from the rest of the rinsing device without the aid of special tools. This easily cleans the plate and accesses the tanks and the mechanism of the pumping device.

In some embodiments, the rinsing device comprises a mechanism for driving the plate in rotation configured to drive the plate in rotation when the cleaning device exerts pressure on the plate. Such rotation of the plate improves the wringing of the cleaning device. The rotation of the plate could also be driven by means of a driving mechanism borne by the cleaning device.

In some embodiments, the driving mechanism comprises a fixed cam surface and at least one follower element secured to the plate. The configuration could be reversed, however.

In some embodiments, the follower element is a pin secured to the piston of the pumping device. The driving mechanism and the pumping mechanism are therefore linked and can be activated simultaneously and in a single movement when the cleaning device exerts pressure against the plate.

In some embodiments, the driving mechanism is configured to drive the plate on a given angle of between 30 and 180°, preferably equal to 60 or 1200, when the cleaning device exerts pressure on the plate. The inventor has in fact noticed that such angles would offer a good compromise between efficacy of the wringing and ease of use, in terms especially of amplitude of the force to be exerted to activate the driving mechanism.

In some embodiments, the rinsing device comprises a blocking device configured to prevent clean water coming from the second tank from reaching the cleaning device when the cleaning device exerts pressure on the activating member of the pumping device. Such a blocking device for example fully wrings out the cleaning device at the end of use, without rewetting it, to bring it to a sufficiently dry state so it can be put away. Such a blocking device is also useful for wringing the cleaning device more strongly, without reinjecting an extra quantity of water, to clean a fragile surface such as a parquet floor, for example.

In some embodiments, the blocking device comprises an obstacle movably mounted on the plate, between a blocking position in which it is placed in front of the nozzles and a clearance position in which it moves away from the nozzles. In such a case, clean water is pumped, discharged via the nozzles, but intercepted by the blocking device and then retrieved by the wastewater tank.

In some embodiments, the rinsing device takes the form of a bucket, the second tank being mounted in the internal volume of the bucket and the bottom of the bucket forming the first tank.

In some embodiments, the rinsing device comprises a supply funnel of the second tank extending from the second tank to the upper edge the bucket. This makes filling the second tank easier.

The present explanation also relates to an assembly comprising a cleaning device and a rinsing device according to any one of the foregoing embodiments. This cleaning device may, or may not, be fitted with an integrated wringing device, for example a wringing device by centrifuge.

In some embodiments, the cleaning device comprises an integrated wringing device, preferably of centrifuge type.

The above features and advantages, as well as any others, will emerge from the following detailed description of embodiments of the proposed device, this detailed description making reference to the appended drawings.

BRIEF DESCRIPTION OF THE DRAWINGS

The appended drawings are diagrammatic and intend especially to illustrate the principles of the invention.

In these drawings, from one figure (FIG.) to the other, identical elements (or parts of elements) are designated by the same reference numerals.

DETAILED DESCRIPTION OF EMBODIMENT(S)

For a more concrete view of the invention, examples of rinsing devices are described in detail hereinbelow in reference to the appended drawings. It is recalled that the invention is not limited to these examples.

Figure 1:
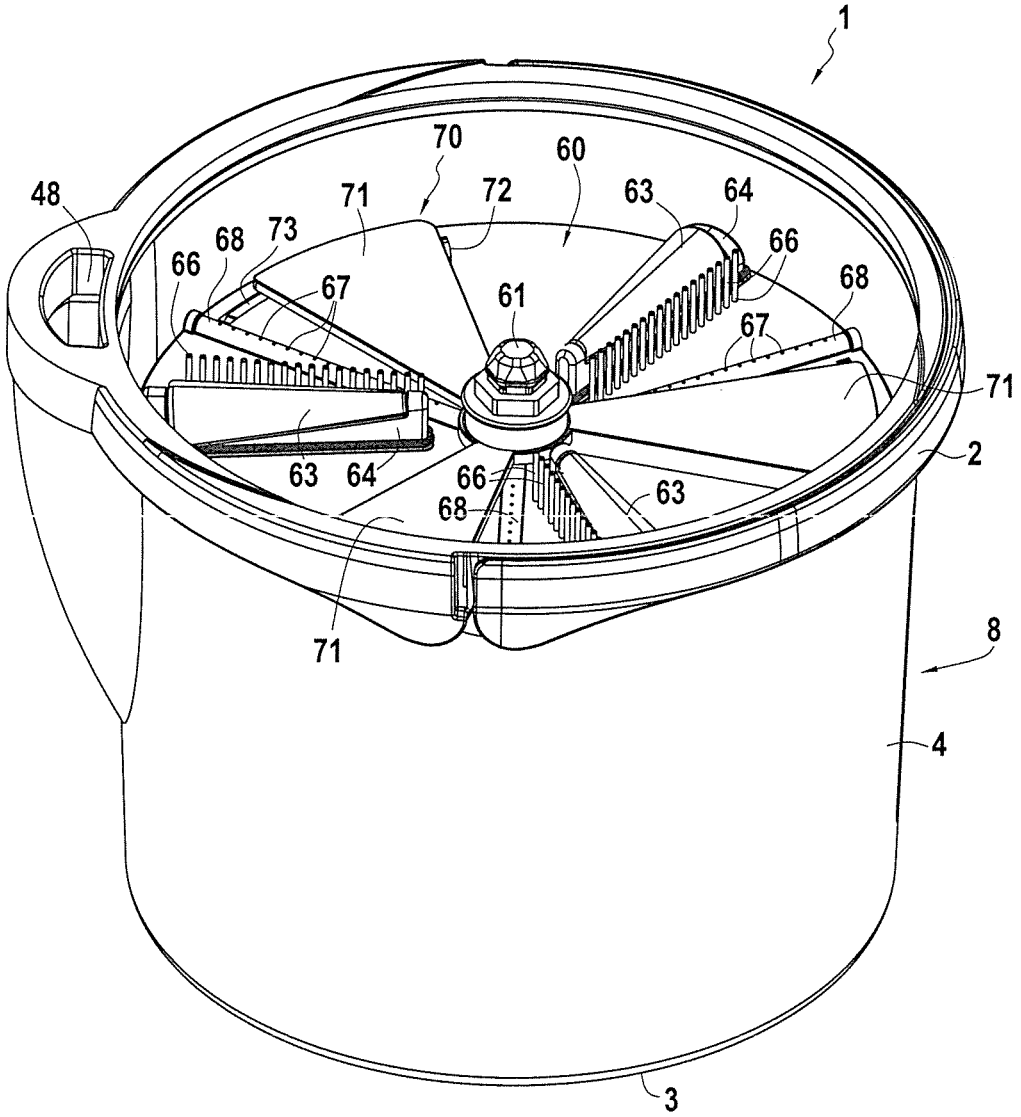
FIG. 1 is a perspective view of a rinsing device according to a first example.
Figure 3:
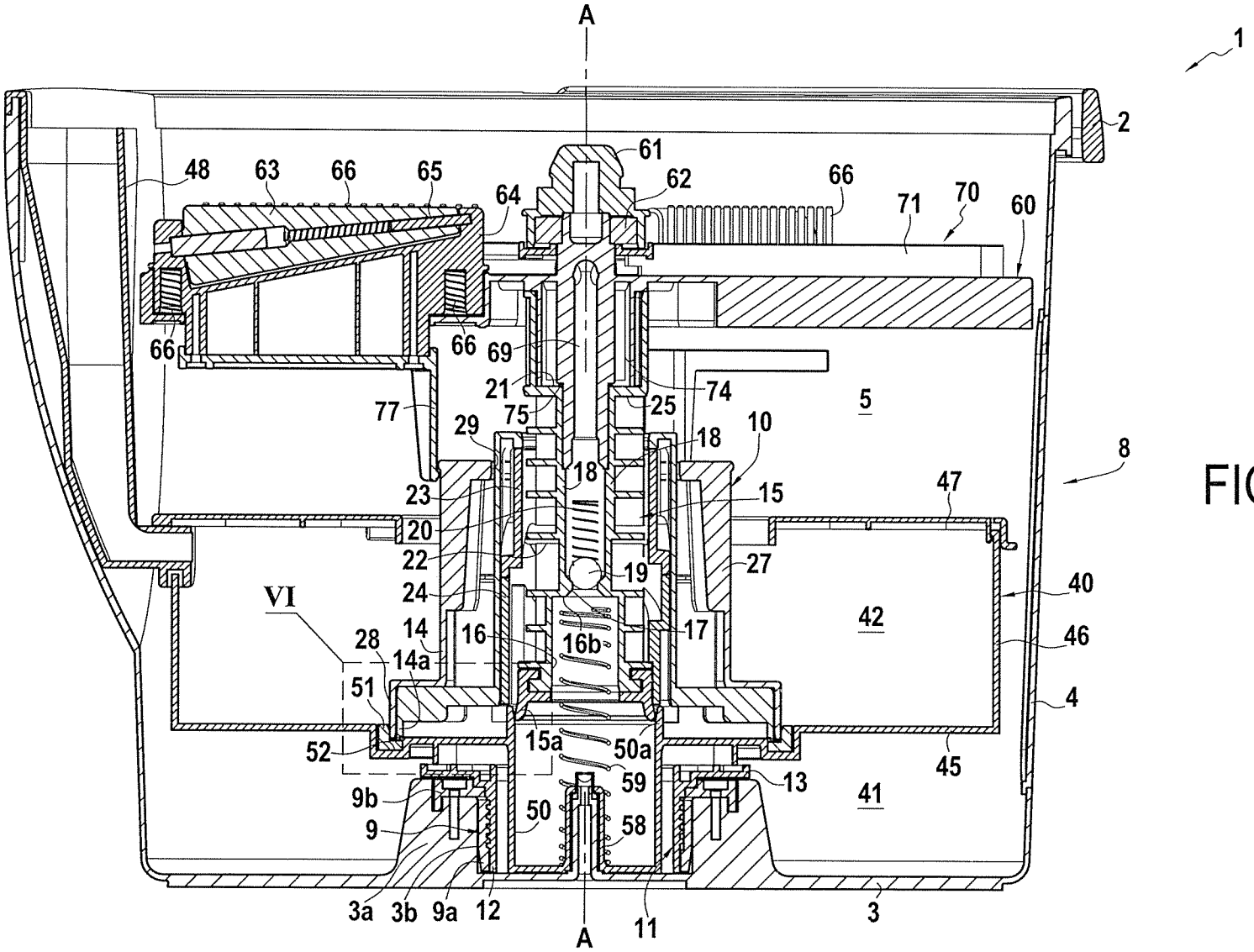
FIG. 3 is a view in axial section of the rinsing device of FIG. 1.
Figure 4:
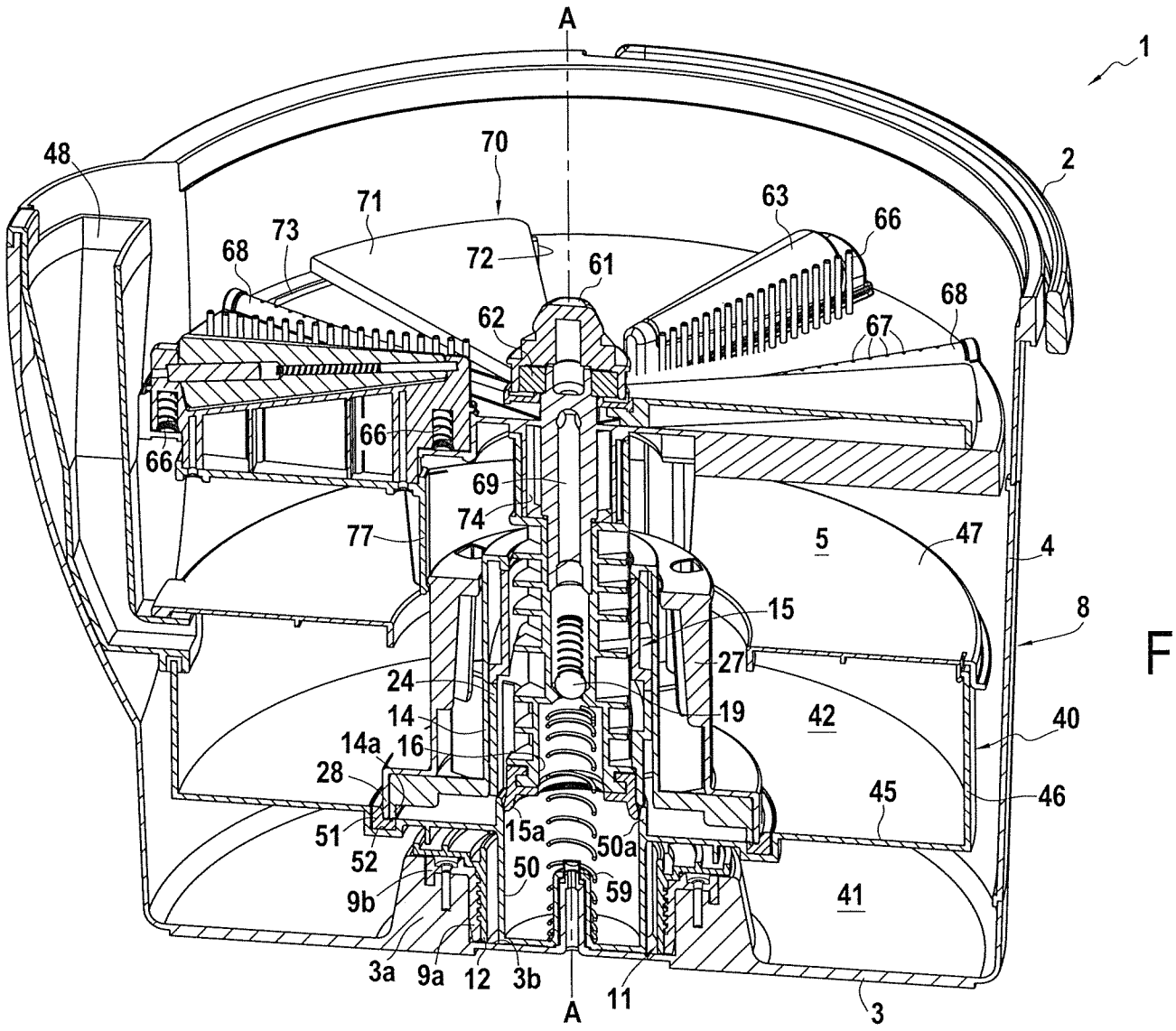
FIG. 4 is a perspective view of the section of FIG. 3.
Figure 5:
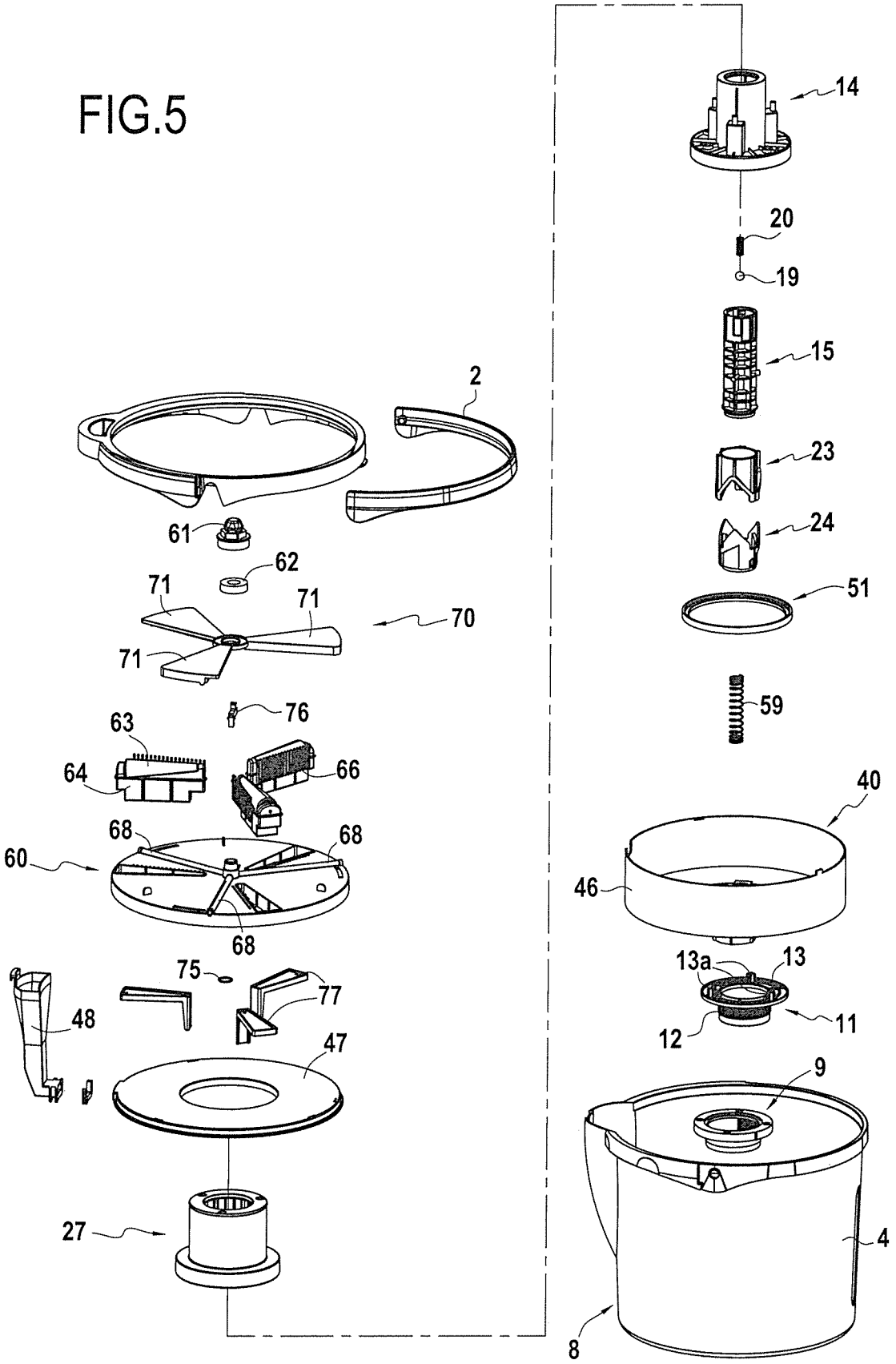
FIG. 5 is an exploded view of the rinsing device of FIG. 1.

FIG. 1 shows a rinsing device 1 according to a first embodiment, in perspective. This rinsing device is also evident in FIGS. 3, 4 and 5. It takes the general form of a bucket 8, fitted with a loop 2, and comprises a base wall 3 and an external circular wall 4 delimiting an internal volume 5. Mounted in this internal volume 5 are a central pillar 10, a vat 40 and a plate 60.

The base wall 3 has in its center an annular protrusion forming an annular promontory 3*a* enclosing a central cavity 3*b*. A mounting base 9, comprising a threaded cylindrical portion 9*a* and a horizontal flange 9*b*, is mounted in the central cavity 3*b*, the flange 9*b* being screwed onto the annular promontory 3*a*.

The lower portion of the internal volume 5 of the bucket 8, in between the base wall 3 and the lower wall 45 of the vat 40, constitutes a first tank 41 intended to collect wastewater. The vat 40, comprising said lower wall 45, an external circular wall 46 and a removable lid 47, for its part forms a second tank 42 intended for storing clean water, optionally mixed with a detergent or another cleaning liquid. The vat 40 is also equipped with a funnel 48 extending from the second tank 42 to the upper end of the bucket 8, enabling easy filling of the second tank 42. Also, the vat 40 comprises a central cavity 50, sinking below the level of the lower wall 45 and delimited by a low wall 50*a* projecting onto the lower wall 45.

Figure 2A:
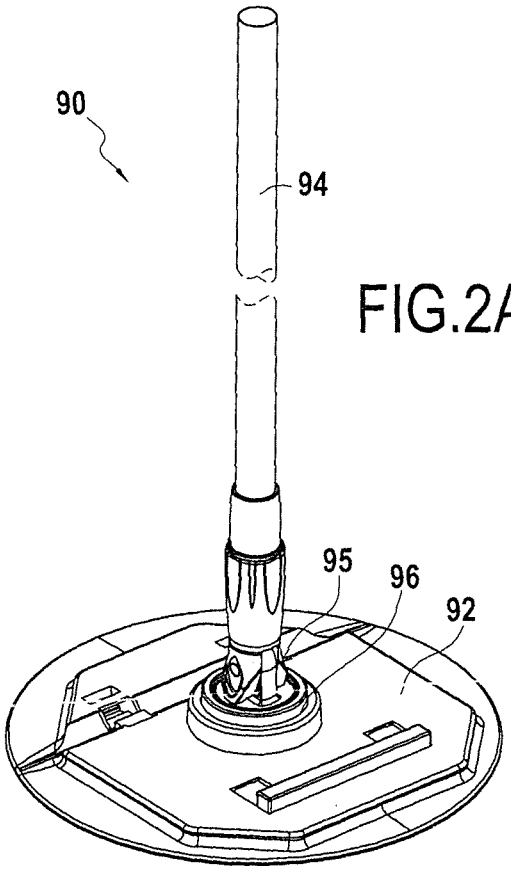
FIGS. 2A and 2B are perspective views of a cleaning device associated to the rinsing device of FIG. 1.
Figure 2B:
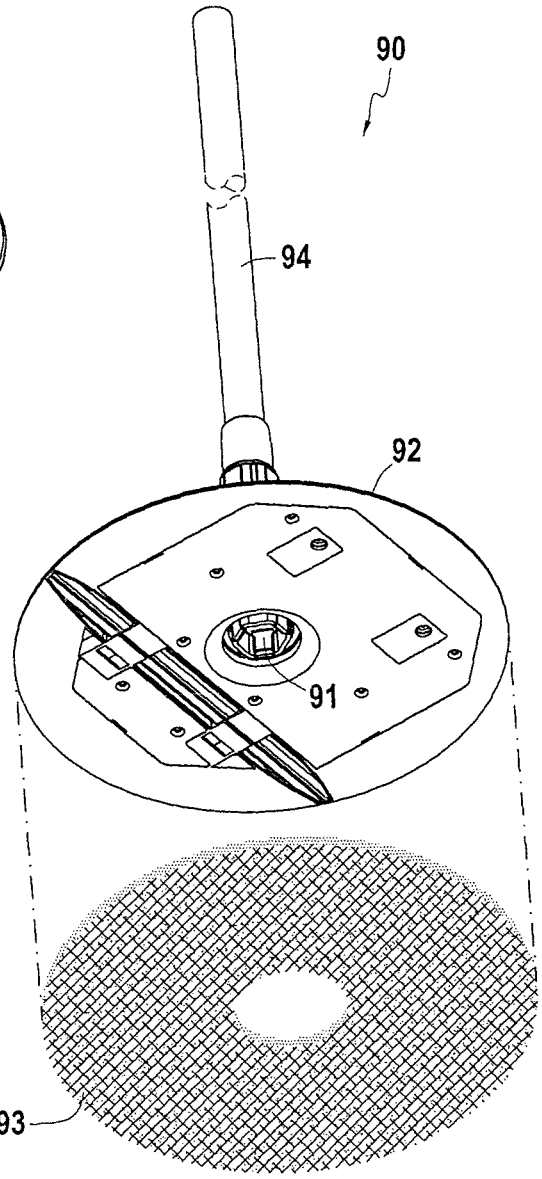

The plate 60, mounted on the central pillar 10, comprises in its center a connecting stud 61, mounted on the plate 60 via a roller 62, configured to cooperate with a connecting cavity 91 provided below the head 92 of the brush 90 associated to the rinsing device 1 and shown in FIGS. 2A and 2B. This brush 90 has also a cleaning trim 93, of the mop micro-fibers type for example, fixed detachably on the lower surface of the head 2 by means of self-fastening strips or buttonholes for example. The brush 90 further comprises a handle 94 mounted on the head 92 by means of a joint 95 of Cardan type and a free wheel 96 enabling the head 92 to turn only in one direction relative to the handle 94.

The plate 60 further comprises wringing rollers 63, three provided in this example, distributed uniformly around the central axis A of the rinsing device 1, and extending radially from this axis A. Each wringing roller 63, of substantially frustoconical shape, is movably mounted in rotation on a baseplate 64; the axis of rotation 65 of the rollers 63 is inclined slightly such that the upper segment of each roller 63 is horizontal.

Also, each baseplate 64 is mounted on the plate 60 so as to enjoy some freedom of movement in the axial direction, springs 66 returning each baseplate 64, and therefore each roller 63, to its position projecting farthest onto the plate 60.

The plate 60 also comprises tufts of brush hairs 66 for easy cleaning of the brush 90. In the present example, the plate 60 comprises three rows of brush hairs 66, each provided along a wringing roller 63.

The plate 60 further comprises water discharge nozzles 67 intended to discharge clean water coming from the second tank 42 on the mop 93 of the brush 90. More precisely, in the present example, the plate 60 comprises three radial conduits 68 distributed evenly around the central axis A and therefore extending radially in a star from this axis A on the surface of the plate 60. Each of the radial conduits 68 is pierced by a plurality of aligned orifices forming the water discharge nozzles 67. Also, the inner end of the radial conduits 68 communicates fluidically with an axial conduit 69 of the plate 60, extending along the central axis A from the lower face of the plate 60, via which clean water coming from the second tank 42 arrives.

Figure 10B:
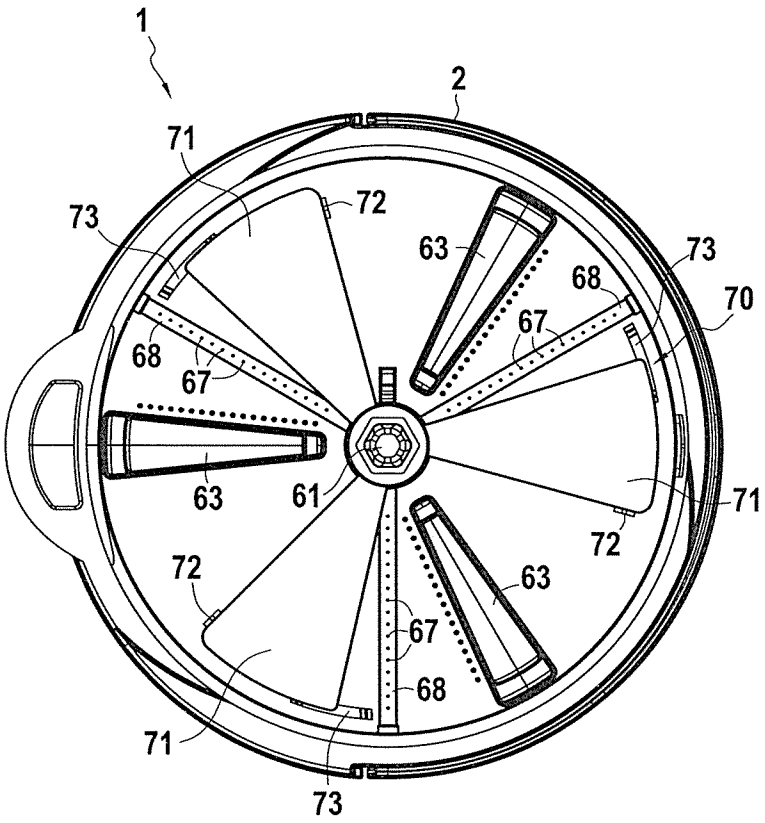
FIGS. 10A and 10B are top plan views of the rinsing device of FIG. 1 with the blocking device in two different positions.
Figure 10A:
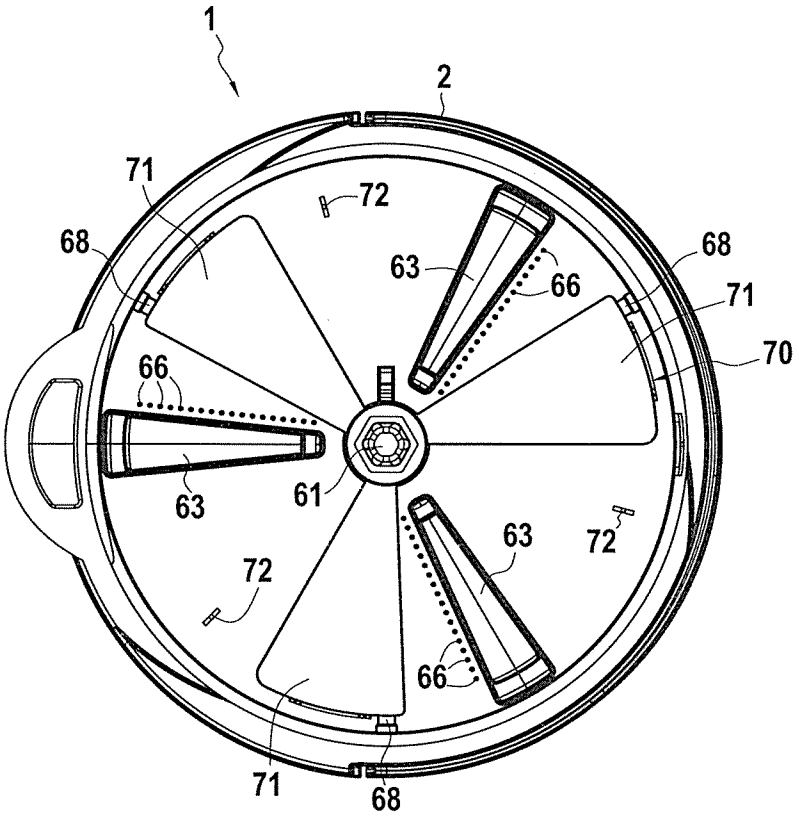

The plate 60 also comprises a blocking device 70, in the present example taking the form of a three-branch helix 71. This blocking device is rotationally mounted between two positions shown in FIGS. 10A and 10B. In the first position, called blocking position and shown in FIG. 10A, each branch 71 covers a radial conduit 68 such that the discharge nozzles 67 are all masked by the blocking device 70. In the second position, called clearance position and shown in FIG. 10B, each branch 71 is stopped against a cleat 72 provided on the plate 60 and reveals the radial conduit 68 such that no obstacle is interposed between the nozzles 67 and the brush 90. A cam device or simply a groove 73 is also provided on the surface of the plate 60, opposite each branch 71, to guide rotation of the blocking device 70 and ensure stability of the blockage and clearance positions, respectively.

The plate 60 further comprises a connecting socket 74 at the central pillar 10, cylindrical and extending axially from the lower face of the plate 60 coaxially to the axial conduit 69 over a length less than the latter.

The central pillar 10 for its part houses a pumping device, for pumping clean water coming from the second tank 42 in the direction of the discharge nozzles 37, and a device for driving in rotation, operating simultaneously to the pumping device, for driving the plate 60 in rotation.

The central pillar 10 first comprises a mounting socket 11 comprising a threaded cylindrical portion 12, taken up and screwed into the mounting base 9. The mounting socket 11 also comprises an annular horizontal support portion 13 bearing three threaded blocks 13*a*.

The vat 40 is then mounted on the mounting socket 11, its central cavity 50 extending within the cylindrical portion 12 of the mounting socket 11.

An annular seal 51, whereof the section assumes the form of an L, is then placed in a circular groove 52 provided in the lower wall 45 of the vat 40. A return spring 59, helicoidal, is also installed in the central cavity 50, vertically along the central axis A, its lower portion engaging around a protrusion 58 projecting vertically from the bottom of the central cavity 50 to the center of the latter.

The central pillar 10 then comprises a framework 14, a piston 15, a first cam cylinder 23 and a second cam cylinder 24 assembled together.

The piston 15, of generally cylindrical form, although having areas or removed material to reduce its mass, comprises a lower cavity 16 open at its lower end and provided with a collar 17 at its upper end.

This collar 17 delimits an orifice enabling the lower cavity 16 to communicate with a discharge conduit 18 made axially in the piston 15. A ball 19 inserted into the discharge conduit 18 is pressed against the collar 17 by means of a spring 20 resting on a shoulder (not shown) of the discharge conduit 18: the ball 19 and the spring 20 form a valve closing the collar 17 unless adequate threshold pressure is exerted against the ball 19 from the lower cavity 16 of the piston.

The piston 15 further comprises an upper cavity 21 open at its upper end and communicating with the discharge conduit 18 at its lower end.

The piston 15 also comprises pins 22, three in this case, provided at regular intervals on the outer piston surface 15.

Figure 7:
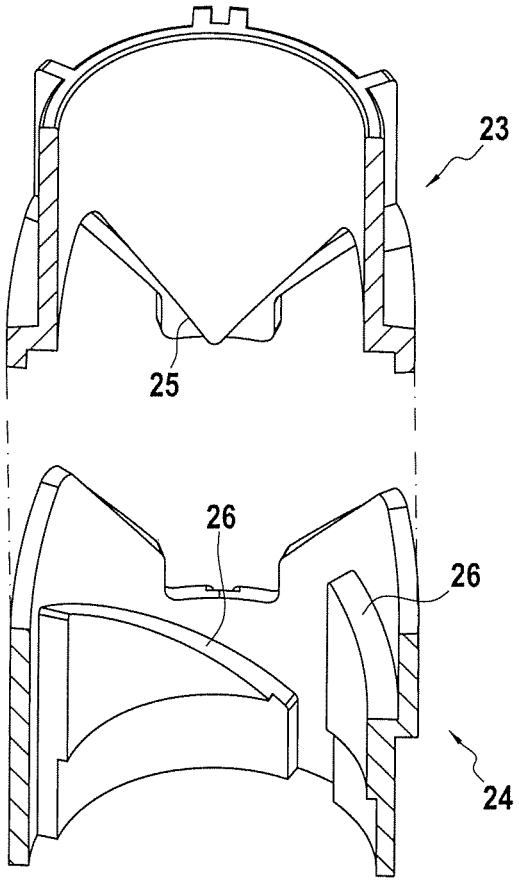
FIG. 7 is a sectional and perspective view of the cam cylinders.
Figure 8:
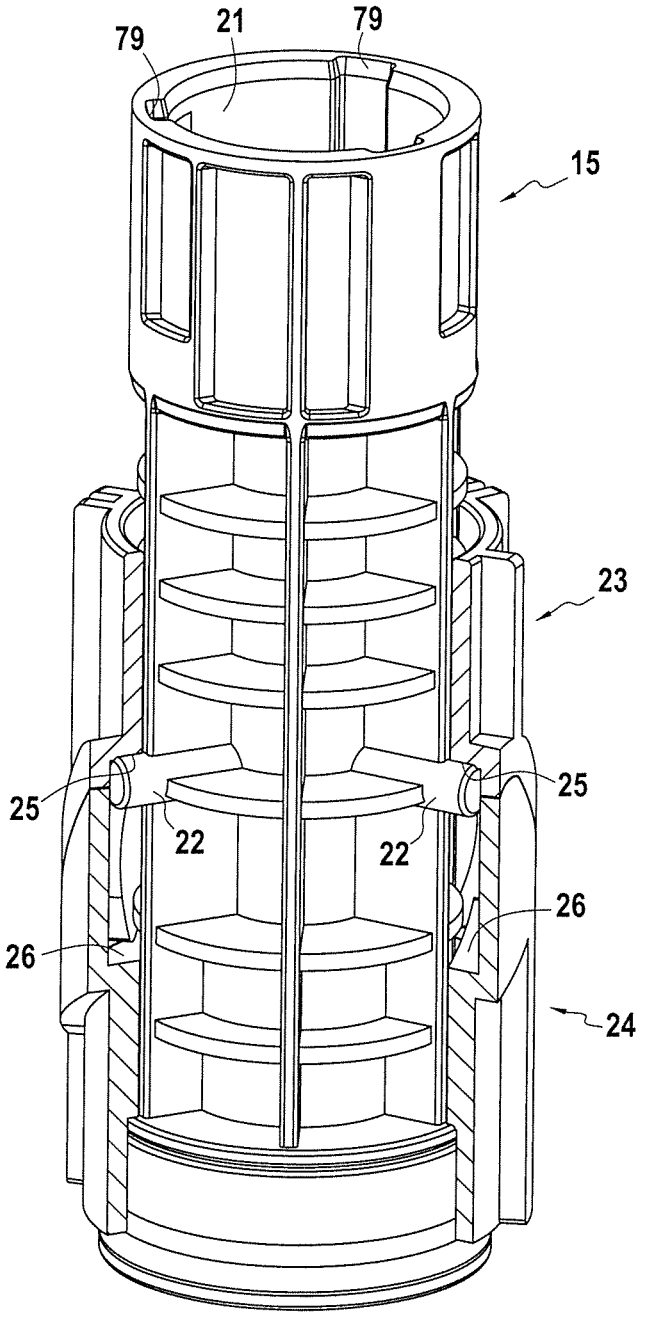
FIG. 8 is a view partially in section of the cam cylinders and piston.

The cam cylinders 23, 24, seen more dearly in FIGS. 7 and 8, are generally cylindrical pieces whereof the inner surface is fitted with reliefs forming cam surfaces 25, 26. The cam cylinders 23, 24 are configured to nest so as to enclose the pins 22 of the piston 15 between the upper cam surface 25, borne by the first cam cylinder 23, and the lower cam surface 26, borne by the second cam cylinder 24.

Therefore, as will be explained later, movement of the pins 22, and therefore movement of the entire piston 15, is restricted by the cam surfaces 25 and 26.

Once the piston 15 and the two cam cylinders 25, 26 are assembled, the assembly is inserted into the cylindrical internal cavity of the framework 14 and the whole is positioned within the vat 40 such that the contour 14*a* of the framework 14 rests on the annular seal 51, that the second cam cylinder 24 rests on the low wall 50*a* enclosing the central cavity 50 of the vat 40, that the lower end of the piston 15, fitted with a skirt 15*a*, penetrates into the central cavity 50, and that the upper end of the return spring 59 is received in the lower cavity 16 of the piston 15 and rests against a shoulder 16*b* of the lower cavity 16.

The framework 14 is screwed onto the threaded blocks 13*a* of the mounting socket 13, via boreholes coinciding with the vat 40, enabling connection of the assembly formed by the mounting socket 13, the vat 40, the framework 14, the cam cylinders 23, 24 and the piston 15.

The central pillar 10 further comprises a casing 27 capping the framework 14, whereof the contour 28 is also applied to the annular seal 51, and fitted with an upper opening 29 through which the apex of the framework 14 and the piston 15 protrude.

The casing 27 is screwed onto the framework 14, which solidly binds together all the pieces of the central pillar 10. Therefore, the assembly of the central pillar 10 can easily be withdrawn from the internal volume 5 of the bucket 8 by unscrewing the mounting socket 12 from the mounting base 9 secured to the base wall 3 of the bucket 8.

The plate 60 is then mounted detachably on the central pillar 10. More precisely, the connecting socket 74 of the plate 60 is received in the upper cavity 21 of the piston 15 until the lower end of the connecting socket 74 is resting against the lower wall of the upper cavity 21 of the piston 15. In the method, the axial conduit 69 of the plate penetrates into the discharge conduit 18 of the piston, a O-ring 75 being provided between an external shoulder of the axial conduit 69 and the lower wall of the upper cavity 21 of the piston 15.

To ensure blockage in rotation of the plate 60 relative to the piston 15, the connecting socket 74 of the plate 60 is fitted with axial flutes cooperating with axial grooves 79 of the upper cavity 21 of the piston 15.

Also, to ensure axial blockage of the plate 60 relative to the piston 15, the plate 60 is fitted with a ratchet 76 comprising a finger configured to penetrate into a blockage hole of the piston: the ratchet 76 is pushed radially in the direction of the central axis A, therefore in the direction of the blockage hole, by means of a spring; the ratchet 76 further has a throttle projecting onto the upper surface of the plate 60 letting a user push the finger of the ratchet 76 back out of the blockage hole for disassembling the plate 60.

Also, the plate 60 has guide tab 77, three in this case, mounted below the baseplates 64, capable of sliding along the casing 27 of the central pillar 10 when the plate 60 rises and descends in the bucket 8 to stabilize the plate 60 relative to the central pillar 10 and reinforce its mechanical strength.

The operation of the rinsing device 1 will now be explained by means of the attached FIGS.

To operate the rinsing device 1, whether at the start of cleaning for initially wetting the mop 93 of the brush 90 or during cleaning for rinsing the mop 93, discharge dirt trapped by the latter and rewet it before a fresh cleaning cycle; the blocking device 70 is positioned in its escape position and then the head 92 of the brush 90 is applied against the plate 60 until the connecting stud 61 engages in the connecting cavity 91 of the brush 90.

In this position, the mop 93 of the brush is in contact with the wringing rollers 63 and the rows of brush hairs 66. The user exerts downwards force on the brush 90 so as to exert pressure against the plate 60 and therefore drive the piston 15 downwards against the return force of the return spring 59.

Figure 9:
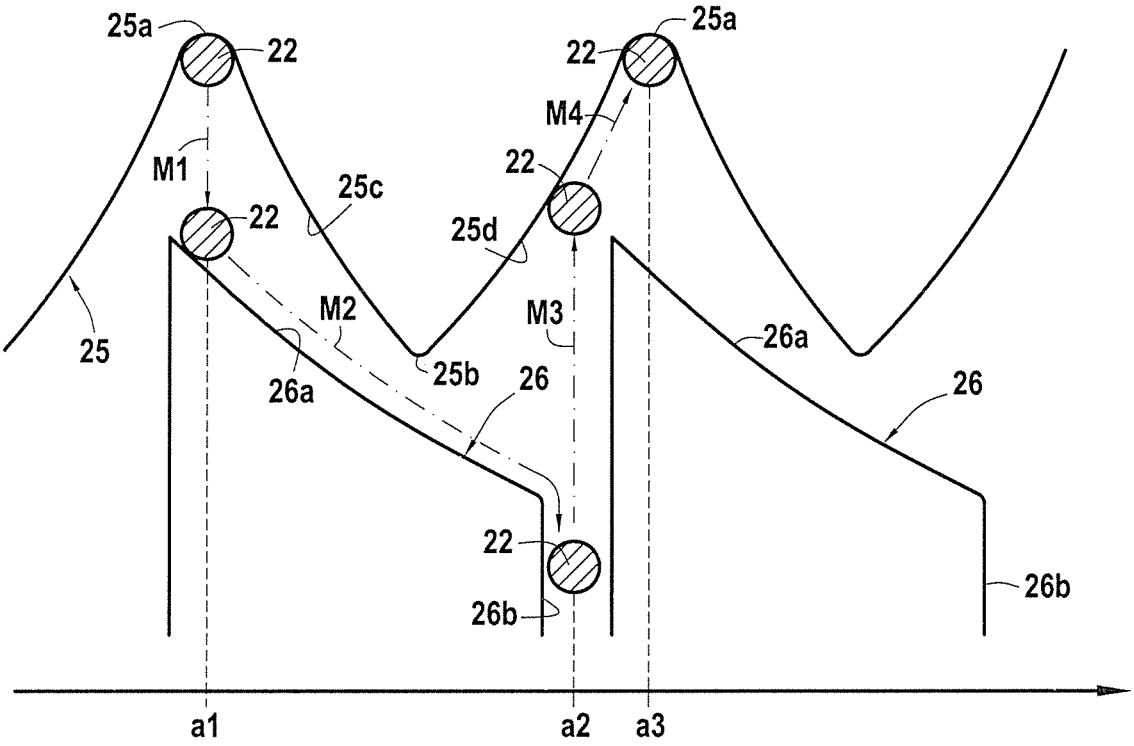
FIG. 9 is a drawing illustrating a developed view of the cam surfaces.

As is evident in FIG. 9, during this movement each pin 22 of the piston 15 will follow the cam surfaces 25, 26 and therefore cause rotation of the piston 15. More precisely, in clockwise direction the first cam surface 25 comprises a succession of throats 25*a* and peaks 25*b* connected by successively descending 25*c* then ascending 25*d* ramps. In clockwise direction the second cam surface 26 per se comprises a succession of descending ramps 26*a*, as saw teeth, separated by valleys 26*b*. In each unified pattern of the cam surfaces 25, 26, i.e., given the repetition of the pattern of the cam surfaces 25, 26, each descending ramp 26*a* extends from an angular position located in behind, in clockwise direction, of the throat 25*a* to an angular position located beyond the following peak 25*b*.

The first and second cam surfaces 25, 26 are periodic and have the same number of repetitions, which is also a multiple of the number of pins 22 borne by the piston 15. In the present example the pattern of the cam surfaces 25, 26 repeats three times, such that 120° separate two throats 25*a* and therefore two positions of stable equilibrium of the piston 15.

In this way, during the descending movement, each pin 22, initially housed in a throat 25*a* of the first cam surface 25, located at an angular coordinate a1, follows a first descending vertical movement M1 to come to a descending ramp 26*a* of second cam surface 26.

With the descending movement prolonging, the pin 22 continues its descent by sliding along the ramp 26*a* until falling into the valley 26*b* located at the angular coordinate a2, following a second movement M2 during which the piston 15 describes a first rotation movement of a2-a1 degrees in clockwise direction.

The descending movement of the brush 90, the plate 60 and the piston 15 is completed when the piston 15 arrives at its compression position stopped at the bottom of the central cavity 50 of the vat 40: the pins 22 are then at the bottom of the valleys 76*b* of the second cam surface 26.

The user can relax the pressure exerted on the plate: the return spring 59 therefore pushes the piston 15 back up.

During this ascending movement, each pin 22 follows a third vertical ascending movement M3 until it comes to the ascending ramp 25*d* of the first cam surface 25.

With the ascending movement prolonging, the pin 22 continues its rise by sliding along the ramp 25*d* until lodging in the following throat 25*a*, located at an angular coordinate a3, following a fourth movement M4 during which the piston describes a second rotation movement of a3-a2 degrees in clockwise direction.

In this way, on completion of a compression cycle, the piston 15 and therefore the plate 60 have achieved rotation of a3-a1 degrees in clockwise direction. In a preferred example, to ensure uniformity of rotation, the valleys 26*b* are located midway from the throats 25*a* such that the piston 15 travels 60° during descent and 60° during ascent.

During a compression cycle, the plate 60 is therefore driven in rotation. So due to the differences in friction at the interface between the plate 60 and the brush head 92, at the roller 62 and at the free wheel 96, a relative rotational movement occurs between the plate 60 and the brush head 92: the wringing rollers 63 and the rows of brush hairs 66 move along the mop 93, enabling it to be wrung and cleaned.

During this wringing, wastewater discharged by the mop 93 flows around the plate 60, falls to the bottom of the bucket 8 and is collected in the first tank 41 intended for wastewater.

After several compression cycles, the wringing rollers 63 and the rows of brush hairs 66 have traveled the entire surface of the mop 93, having completed wringing and cleaning of the latter.

Figure 6:
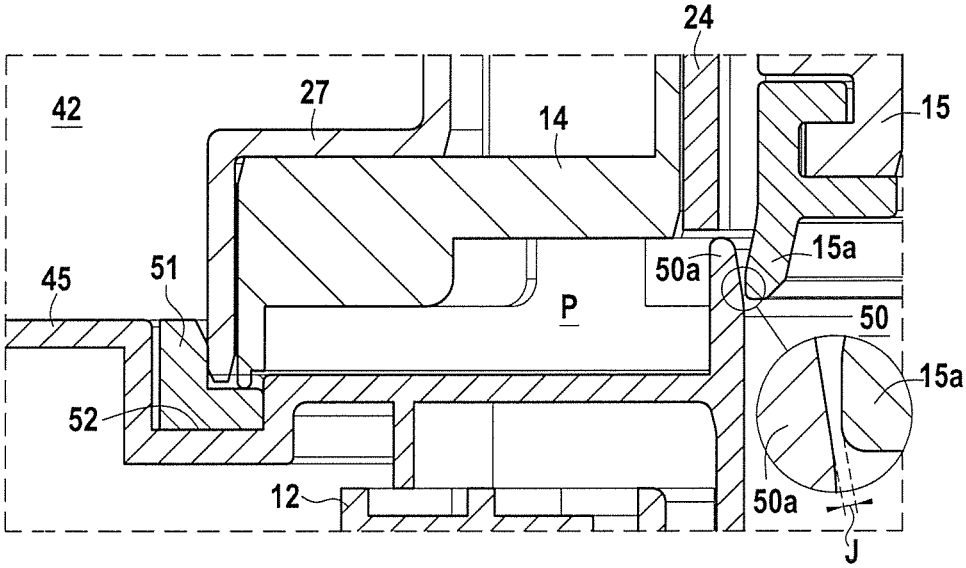
FIG. 6 is an enlarged view of the frame VI of FIG. 3.

Along with each compression cycle, clean water coming from the second tank 42 is pumped and injected into the mop 93. In fact, as is clearer in FIG. 6, which is an enlargement of the framework VI of FIG. 3, a filling passage P connects the second tank 42 and the central cavity 50, forming a compression chamber, of the vat 40.

The passage section of this filling passage P is limited to two places. Upstream first of all the seal 51 limits the rate of clean water entering the filling passage P at the interface between the framework 14 and the casing 27 on the one hand and the lower wall 45 of the vat 40 on the other hand. Downstream then, the passage section of the filling passage P is limited by the narrowness of the clearance 3 left between the low wall 50*a* of the compression chamber 50 and the skirt 15*a* of the piston 15. In this example, when the piston 15 is in its high rest position, the clearance J measures about 0.1 mm.

However, though limited, this passage rate is enough for the compression chamber 50 to be able to fill completely during the interval separating two uses of the rinsing device 1, i.e., while the user uses the brush 90 to clean the relevant surface. In this way, in the present example the compression chamber 50 is capable of filling completely in fewer than 30 seconds; for this, the filling rate via the filling passage P is around 1 cl/s.

But this passage rate is sufficiently low relative to the actuation time of the rinsing device 1 to overlook, or at least minimize, the reflux rate of the compression chamber 50 to the second tank 42 during actuation of the rinsing device 1, i.e., when the piston 15 is descending in the compression chamber 50.

In particular, the reflux rate can be less than the filling rate. In the present example the low wall 50*a* has a beveled profile which causes a decrease in the clearance 3 during descent of the piston 15 in the compression chamber 50. In this way, the reflux rate via the filling passage P is less than 0.5 cl/s. In practice, it is estimated that the quantity of water capable of flowing back via the filling passage P during a compression cycle is limited to 1 or 2 mL, which is sufficiently low to allow the rise in pressure in the compression chamber 50 and discharge of the water via the discharge conduit 18.

Therefore, during activation of the rinsing device 1 the compression chamber 50 is initially filled with clean water. The rapid descent of the piston 15 boosts the pressure of the water in the compression chamber 50, while the collar 17 of the piston 15 is blocked by the ball 19 and reflux of the water via the filling passage P, impeded, is negligible given the compression speed. Once the threshold pressure is reached, the ball 19 is pushed back against its spring 20 and clean water is expelled via the discharge conduit 18, the conduit axial 69, the radial conduits 68 and the nozzles 67 as far as the mop 93 of the brush 90.

Since not all water is being expelled at once, it is possible to repeat the operation to discharge a quantity of clean water several more times in the direction of the mop 93. Due to the driving in rotation of the plate 60 occurring simultaneously with discharge of water, and due to the relative movement appearing between the plate 60 and the brush head 92, it is possible to rinse a large surface, if not the entire surface, of the mop 93.

On completion of several compression cycles, for example five consecutive cycles, at a frequency of around one cycle per second, the level of water in the compression chamber 50 becomes insufficient to again discharge water, which is a signal for the user that rinsing has finished and he can again use the brush 90 to clean the relevant surface. During this time the compression chamber 50 can refill.

After use of the brush 90, when the relevant surface is totally cleaned and the brush 90 is to be put away in a cupboard for example, it is possible to use the rinsing device one last time by shifting the blocking device 70 into its blocking position this time. In this way, each compression cycle will turn the plate 60 and therefore clean and wring out the mop 93 of the brush 90 but without rewetting the latter, the water discharged via the nozzles 67 being intercepted by the branches 71 of the blocking device 70 and deflected directly towards the first tank 41 dedicated to wastewater.

Figure 11:
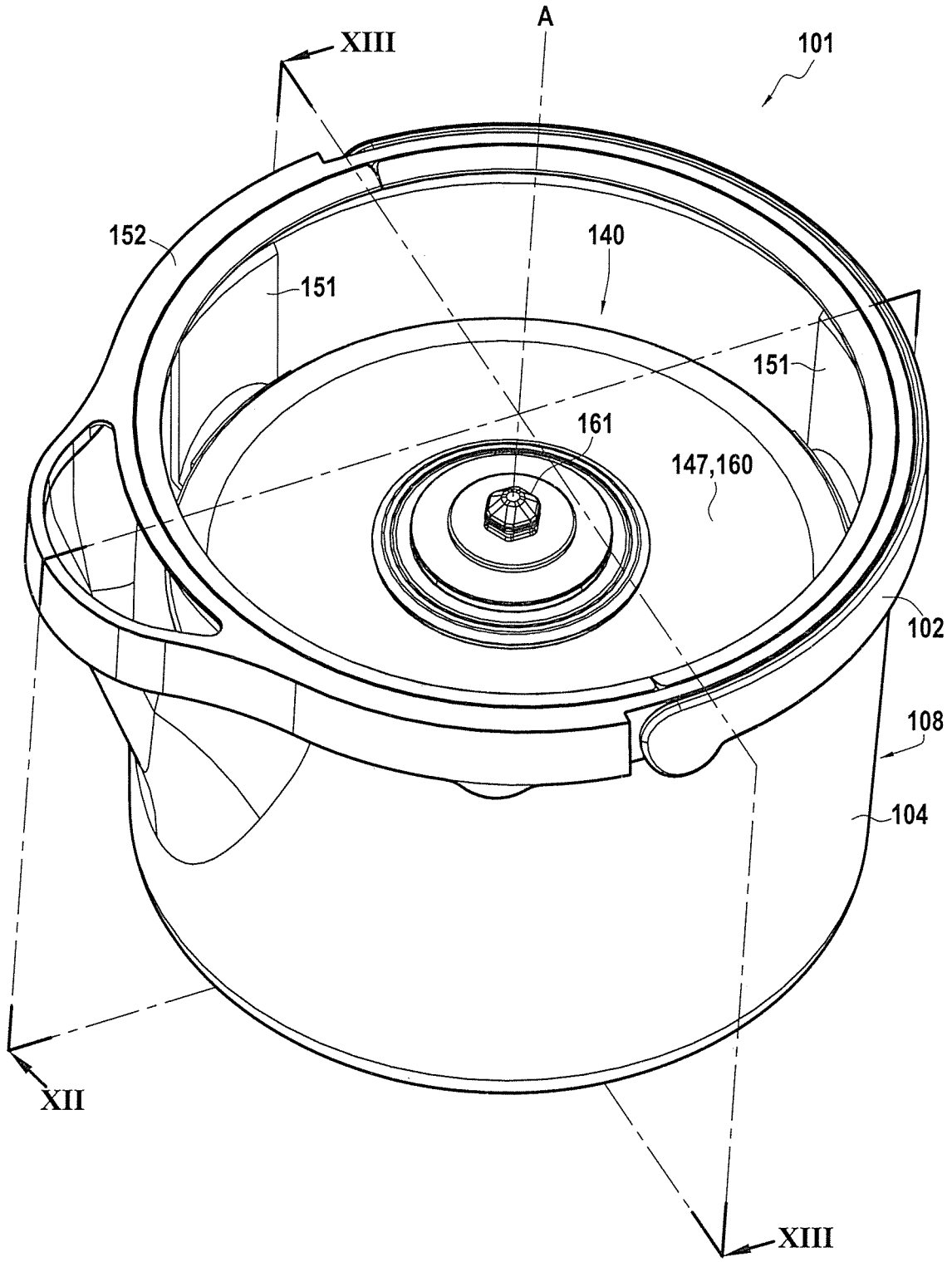
FIG. 11 is a perspective view of a rinsing device according to a second example.
Figure 12:
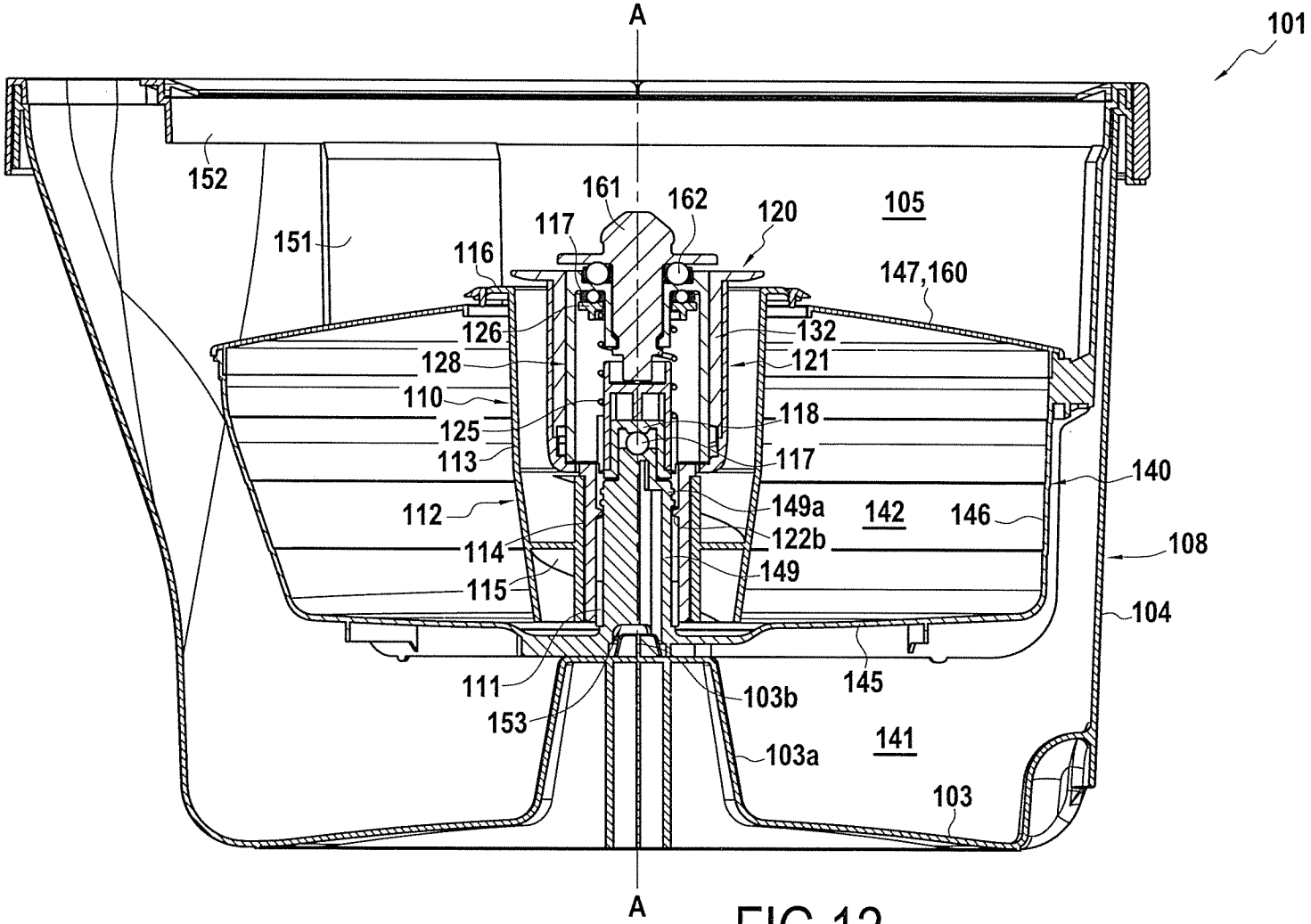
FIG. 12 is a view in axial section, according to the plane XII, of the rinsing device of FIG. 11.
Figure 13:
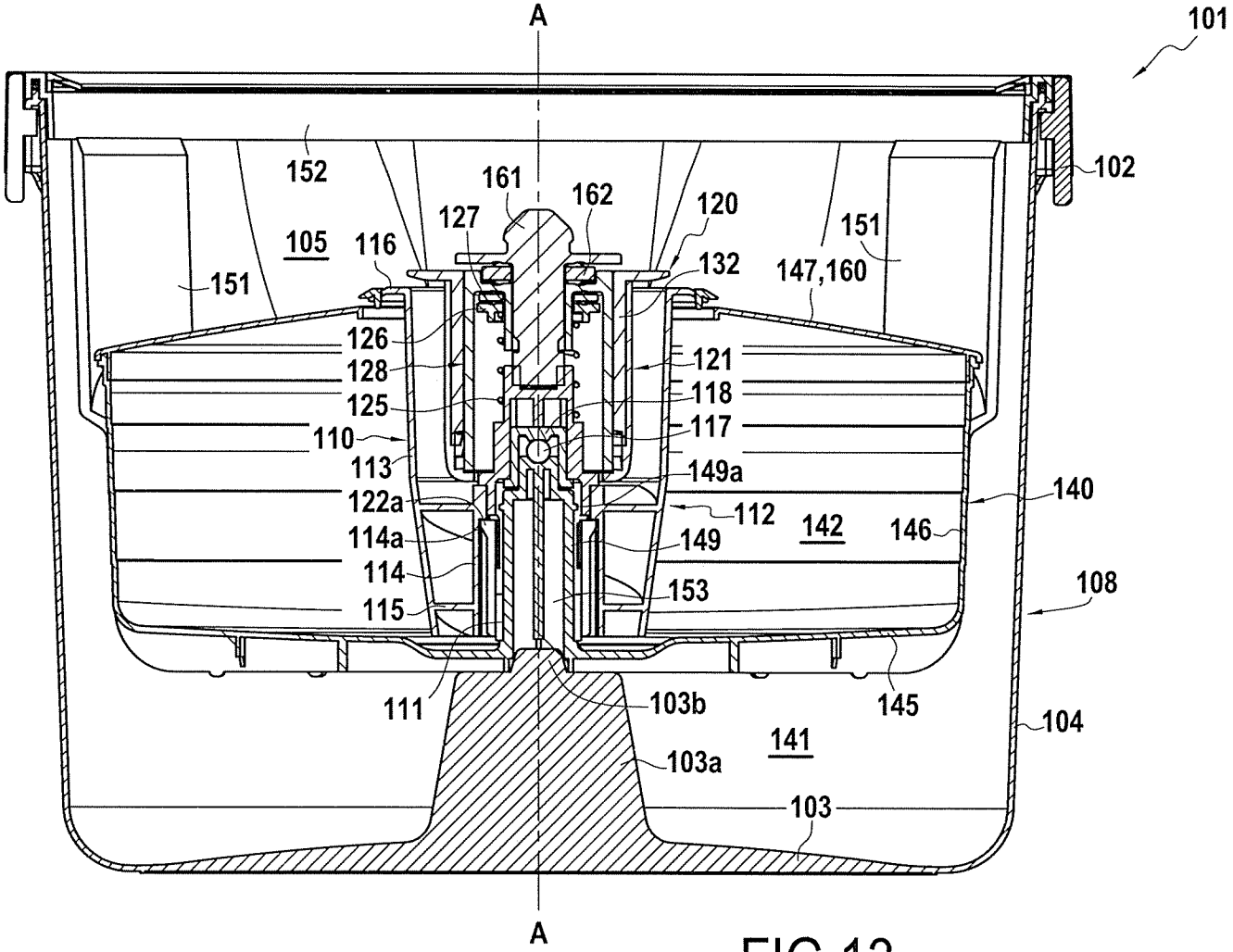
FIG. 13 is a view in axial section, according to the plane XIII, perpendicular to the plane XII, of the rinsing device of FIG. 11.
Figure 14:
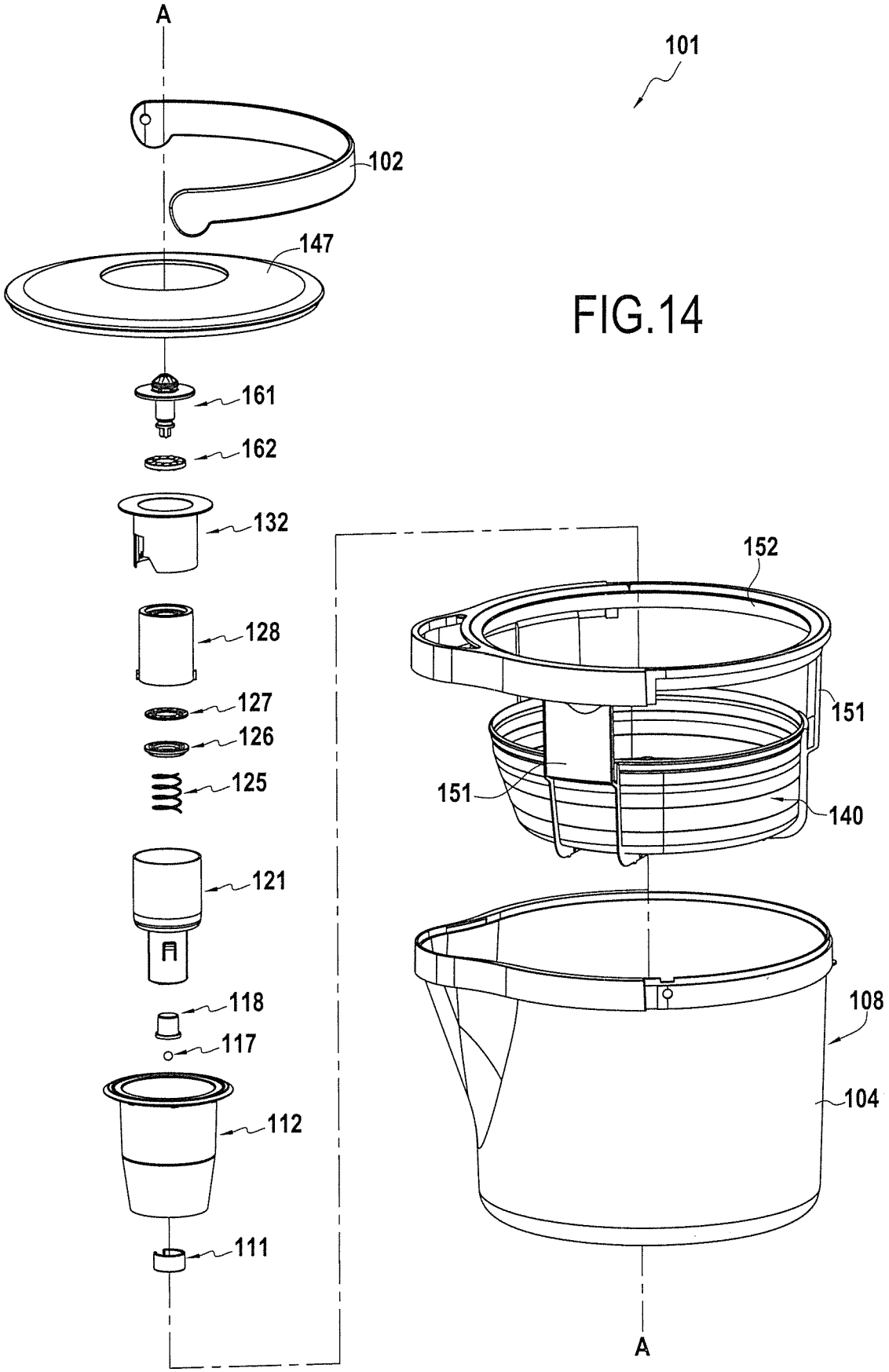
FIG. 14 is an exploded view of the rinsing device of FIG. 11.
Figure 15:
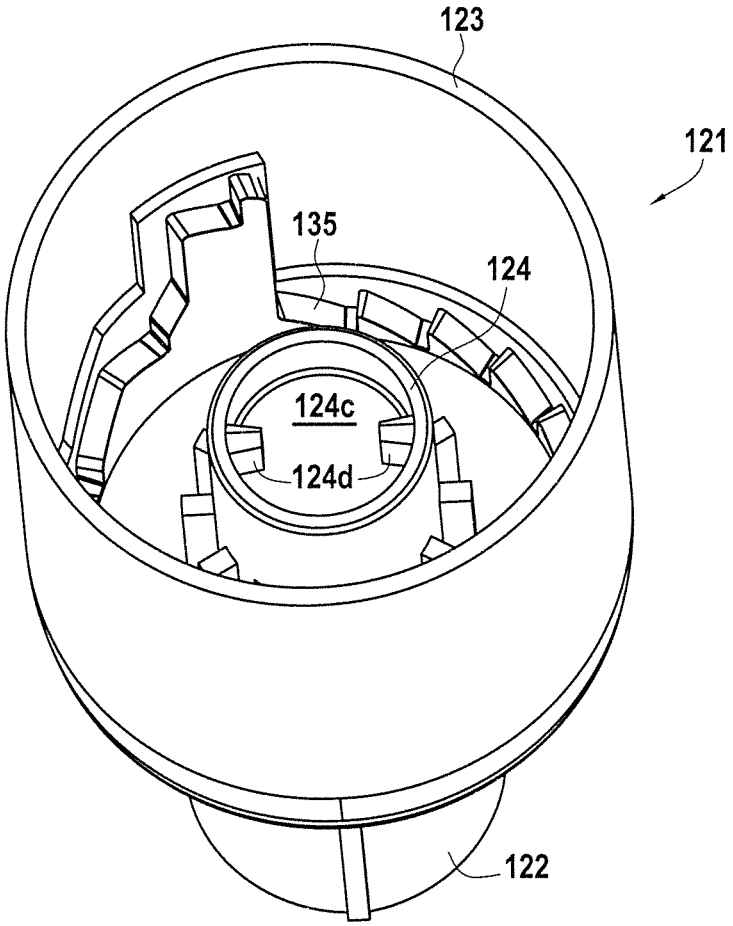
FIG. 15 is a perspective view of the transmission piece.

FIG. 11 is a perspective view of a rinsing device 101 according to a second embodiment. This rinsing device 101 is also shown in FIGS. 12, 13 and 14. It takes the general form of a bucket 108, fitted with a loop 102, and comprises a base wall 103 and an external circular wall 104 delimiting an internal volume 105. A vat 140 is mounted in this internal volume 105. This rinsing device 101 is provided to cooperate with a brush 90 of the same type as that of the first example shown in FIGS. 2A and 2B except that the brush 90 is fitted with a device for driving the brush head 92 in rotation.

The base wall 103 has in its center a cylindrical outgrowth forming a promontory 103*a* fitted in its center with a protrusion 103*b*.

The vat 140 is suspended by three arms 151 to a suspension ring 152 mounted astride the upper edge of the external circular wall 104 of the bucket 108. In this suspended state, the vat 140 also rests on the apex of the promontory 103*a*, the protrusion 103*b* engaging in a cavity 153 provided at the center of the lower wall 145 of the vat 140.

The lower portion of the internal volume 105 of the bucket 108, in between the base wall 103 and the lower wall 145 of the vat 140, constitutes a first tank 141 intended to recover wastewater. For its part the vat 140, comprising said lower wall 145, an external circular wall 146 and a removable lid 147, forms a second tank 142 intended for storage of clean water, optionally mixed with a detergent or another cleaning liquid.

A pumping device 110, for pumping clean water coming from the second tank 142 in the direction of the plate 160 formed by the lid 147 of the second tank 142, as well as a lift device 120, for adjusting the position of the brush 90 relative to the plate 160, are mounted within the vat 140 along the central axis A of the rinsing device 101.

The vat 140 comprises at its center a column 149 extending along the central axis A over around half the height of the vat 140, the cavity 153 mentioned earlier corresponding to the inner space of this column 149.

A slotted centering sleeve 111 is threaded with clearance around the column 149 and rests on a shoulder of the lower wall 145 of the vat 140.

A pumping cylinder 112 is put in place at the center of the vat 140, around the column 149. It comprises an external wall 113, substantially cylindrical, extending substantially over the entire height of the vat 140, and an internal wall 114, substantially cylindrical, extending along the column 149 only. An Archimedes screw 115, double in the present example, is formed between the external wall 113 and the internal wall 114 of the pumping cylinder 112. The pumping cylinder 112 also comprises an annular skirt 116 extending substantially radially from the upper end of the external wall 113.

The apex of the column 149 is fitted with a bowl on which a ball 117 is placed. A cap piece 118, in the form of a top-hat, is then placed over the ball 117 and the apex of the column 149, the apex of the ball 117 being taken up in a bowl provided in the internal space of the hat piece 118: the hat piece 118 is rotationally mounted relative to the column 149.

A transmission piece 121 is then put in place within the vat 140. This piece is also shown in FIGS. 15, 16, 17 and 18, comprising a lower cylinder 127 connected to an upper cylinder 123, of larger diameter and forming a first cam cylinder, and further comprising a central column 124 of diameter less than that of the lower cylinder 122. The lower cylinder 122 is received with clearance between the centering sleeve 111 and the internal wall 114 of the pumping cylinder 112, whereas the internal cavity 124*a* formed by the central column 124 is engaged around the hat piece 118 until an axial stop 124*b* of the internal cavity 124*a* rests on the apex of the hat piece 118.

The lower cylinder 122 has locking fingers 122*a* provided to engage irreversibly in notches 114*a* of the internal wall 114 of the pumping cylinder 112 so as to secure the pumping cylinder 112 to the transmission piece 121.

The lower cylinder 122 also has internal grooves 122*b* for axially blocking the transmission piece 121 by screwing onto a screw thread 149*a* of the column 149 of the vat 140.

The central column 124 of the transmission piece 121 further comprises at its upper end an upper cavity 124*c*, open upwards, within which two radial lugs 124*d* protrude diametrically opposite.

A spring 125 is then placed around the central column 124 of the transmission piece 121, the lower end of the spring 125 bearing on a shoulder of the central column 124.

A cup 126, bearing a first roller 127, is then positioned at the apex of the spring 125, with a shoulder of the cup 126 bearing on the upper end of the spring 125.

Figure 18:
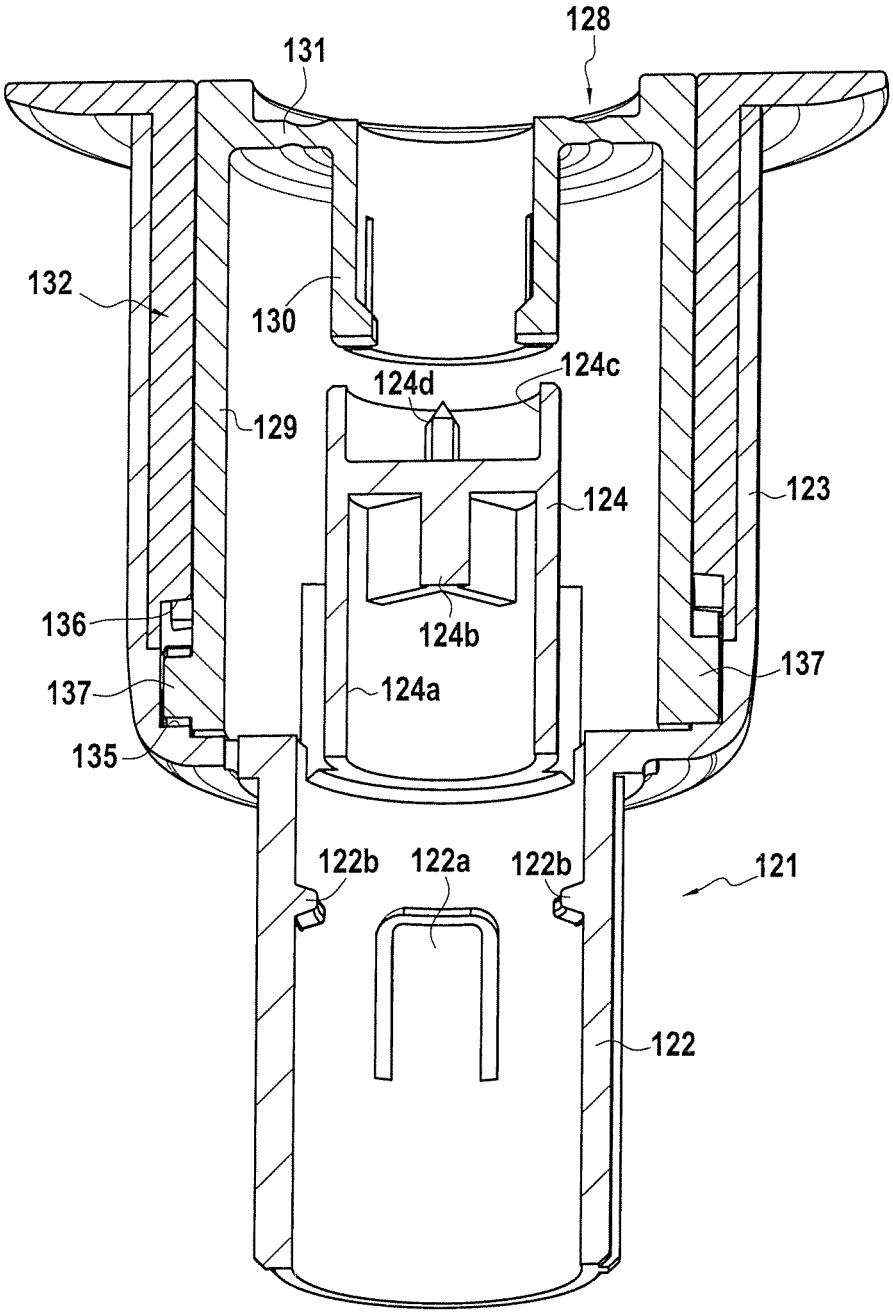
FIG. 18 is a sectional view of the cam cylinders and follower cylinder.

A follower cylinder 128, also shown in FIG. 18, is then positioned within the transmission piece 121. The follower cylinder comprises an external cylinder 129 extending over the whole height of the upper cylinder of the transmission piece 121 and an internal cylinder 130, of diameter substantially equal to that of the column 124 of the transmission piece 121, extending over around one third of the length of the external cylinder 129, the external cylinder 129 and the internal cylinder 130 being connected by a radial ring 131. The internal cylinder 130 engages within the spring 125 whereas the lower surface of the radial ring 131 is connected to the first roller 127.

At the lower end of its external cylinder 129, the follower cylinder 128 also comprises two pins 137 diametrically opposite and extending radially towards the exterior. As is more clearly shown in FIG. 18, the rear, upper and lower ridges of each pin 137 are chamfered.

Figure 16:
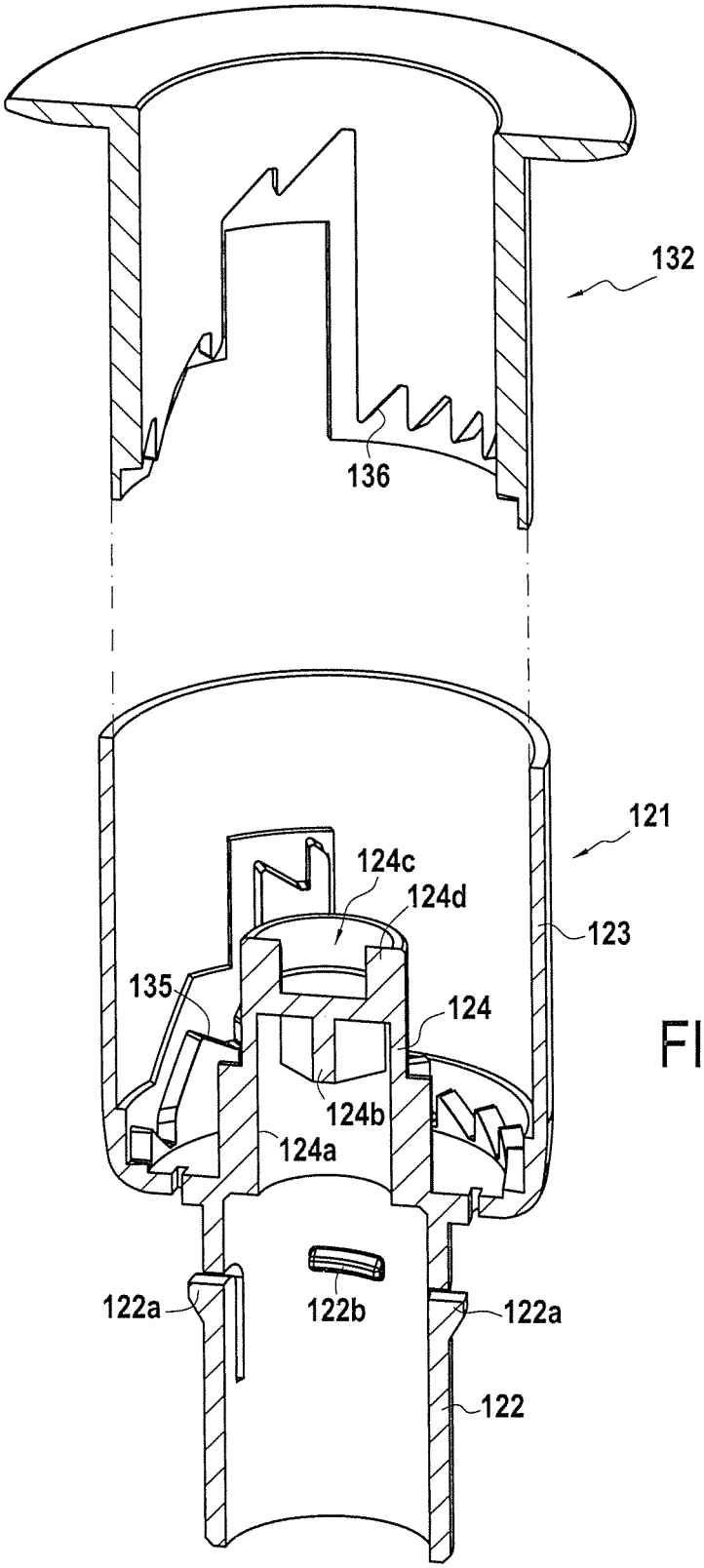
FIG. 16 is a sectional and perspective view of the cam cylinders.
Figure 17:
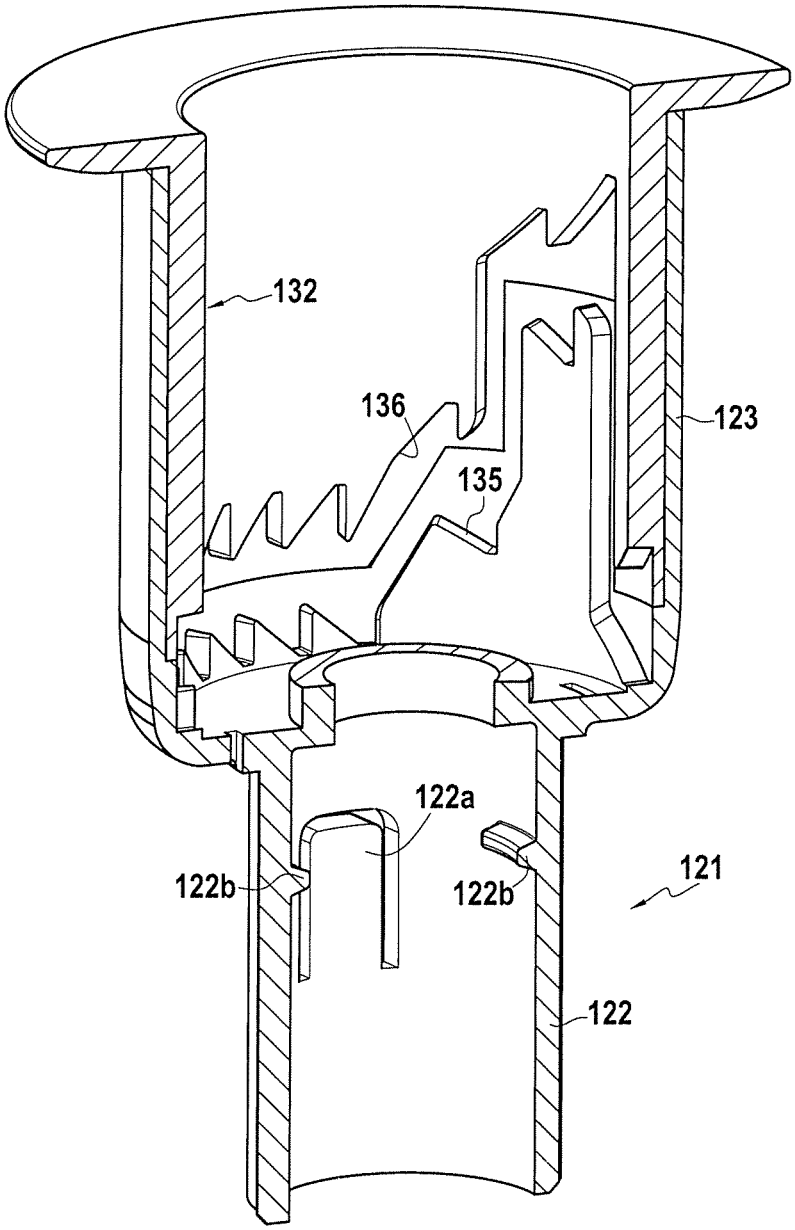
FIG. 17 is another sectional and perspective view, partially truncated, of the assembled cam cylinders.

A second cam cylinder 132, substantially cylindrical, also shown in FIGS. 16, 17 and 18, is engaged between the first cam cylinder 123, formed by the external cylinder of the transmission piece 121, and the follower cylinder 128, the second cam cylinder 132 being fixed to the first cam cylinder 123.

The cam cylinders 123, 132 are portions of generally cylindrical pieces whereof the inner surface is fitted with reliefs forming cam surfaces 135, 136. The cam cylinders 123, 132 are configured to nest so as to enclose the pins 137 of the follower cylinder 128 between the lower cam surface 135, borne by the first cam cylinder 123, and the upper cam surface 136, borne by the second cam cylinder 132.

Therefore, as will be explained later, the movement of the pins 137, and therefore the movement of the follower cylinder 128 in its entirety, is restricted by the cam surfaces 135 and 136.

Figure 19:
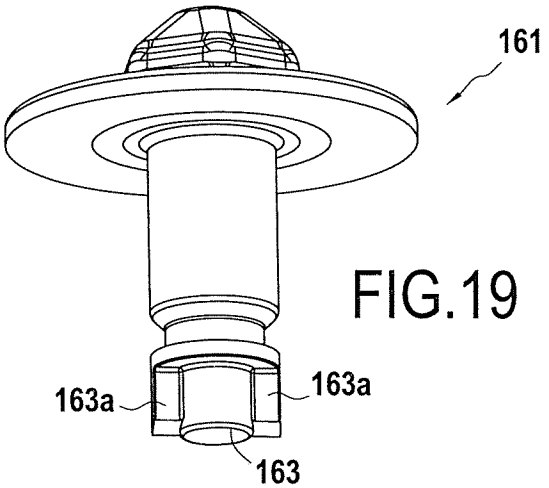
FIG. 19 is a perspective view of the connecting member.

Finally, a connecting stud 161, also shown in FIG. 19, is mounted on the follower cylinder 132 by means a second roller 162. Similarly to the first example, this connecting stud 161 is configured to cooperate with a connecting cavity 91 provided below the head 92 of the brush 90 connected to the rinsing device 101. The lower end of the connecting stud 161 extends towards the upper cavity 124*c* of the column 124 of the transmission piece 161 and comprises a locking finger 163 fitted with two radial lugs 163*a* diametrically opposite.

The operation of the rinsing device 101 will now be explained by means of the appended FIGS.

To make the rinsing device 101 work, whether at the start of cleaning to initially wet the mop 93 of the brush 90 or during cleaning for rinsing the mop 93, discharge dirt trapped by the latter and rewet before a fresh cleaning cycle; the head 92 of the brush 90 is applied against the connecting stud 161 so as to engage the latter in the connecting cavity 91 of the brush 90.

In this position, the mop 93 of the brush is in contact with the plate 160 formed by the lid 147 of the vat 140. The user actuates the device for driving the brush 90 in rotation by performing vertical out-and-back movements with the brush 90 or with a movable member of the brush, such as a sleeve, according to the model of device for driving in rotation. The head 92 of the brush 90 then starts to turn, at the same time causing rotation of the connecting stud 161.

Also, in this position, the locking finger 163 of the connecting stud 161 penetrates the upper cavity 124*c* of the column 124 of the transmission piece 121 such that the lugs 163*a* of the locking finger 163 push the lugs 124*d* of the column 124, driving the transmission piece 121 in rotation.

Therefore, since the pumping cylinder 112 is secured to the transmission piece 121, the Archimedes screw 115 of the pumping cylinder 112 is driven in rotation, which causes a rise in clean water in the pumping cylinder 112 from the tank clean water 142, the clean water being released along the skirt 116 before flowing along the plate 160 formed by the lid 147 of the vat 140. The mop 93 of the brush 90 turning on contact with the plate 160 can be rinsed with this clean water and can be wetted again. Also, the surface of the plate 160 is inclined slightly outwards so as to enable discharge of excess clean water to the wastewater tank 141.

Also, with each out-and-back movement the brush 90 exerts a descending force against the connecting stud 161, and therefore against the follower cylinder 128, against the return force of the spring 125.

Figure 20:
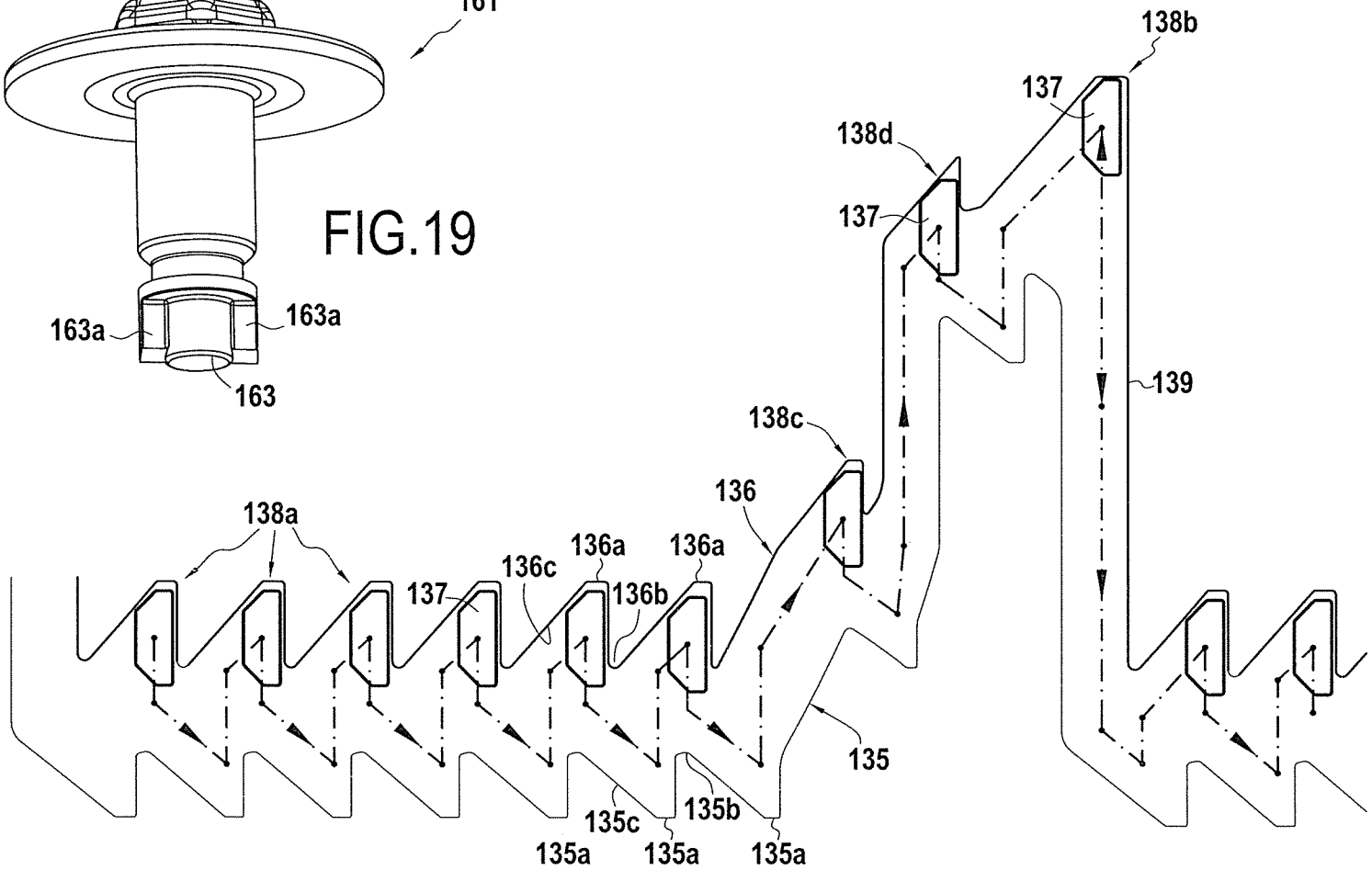
FIG. 20 is a drawing illustrating a developed view of the cam surfaces.

As is shown in FIG. 20, during this movement each pin 137 of the follower cylinder 128 will follow the cam surfaces 135, 136.

More precisely, in clockwise direction, the first cam surface 135 comprises a succession of throats 135*a* and peaks 135*b* in saw tooth pattern connected by descending ramps 135*c*. In clockwise direction, the second cam surface 136 per se comprises a succession of throats 136*a* and peaks 136*b* in saw tooth pattern connected by ascending ramps 136*c*. Systematically, a throat 135*a* of the first cam surface 135 is located opposite an ascending ramp 136*c* of the second cam surface 136 and a throat 136*a* of the second cam surface 136 is located opposite a descending ramp 135*c* of the first cam surface 135.

The first and second cam surfaces 135, 136 are periodical and present the same number of repetitions, which is also a multiple of the number of pins 137 carried by the follower cylinder 128. In the present example, the pattern of cam surfaces 135, 136 is repeated twice.

By way of the spring 125, all the throats 136*a* of the second cam surface 136 define stable positions for the pins 137 of the follower cylinder 128.

In FIG. 20, by way of explanation, a pin 137 has been shown in each of the available stable positions: yet it must be understood that these stable positions are in reality occupied successively by pins 137. A unified pattern comprises six lower stable positions 138*a* located at a lower level, a stable upper position 138*b* located at an upper level, and two intermediate stable positions 138*c* and 138*d* located at two different levels, rising between the lower level and the upper level. A vertical distance of around 4 cm separates the lower level from the upper level.

The force to be exerted against the spring 125 to move from a stable position 138*a*-138*d* to the following is a function of the vertical distance separating this stable position from the throat 135*a* of the first cam surface 135 located immediately after in clockwise direction. In this case, with the exception of the case of the stable upper position 138*b*, vertical displacement of 1 cm maximum is enough to reach the following throat 135*a*: therefore, moderate force exerted downwards is enough to enable passage to the following stable position. In practice, the out-and-back movement necessary for activation of the device for driving the brush 90 in rotation is sufficient for progressing from stable position to stable position to reach the stable upper position 138*b*.

In this way, the brush 90 stays in a lower position, in contact with the plate 160, during five out-and-back movements, considered sufficient for rinsing the mop 63, then the brush 90 rises progressively over three out-and-back movements prior to reaching its upper position.

Figure 21:
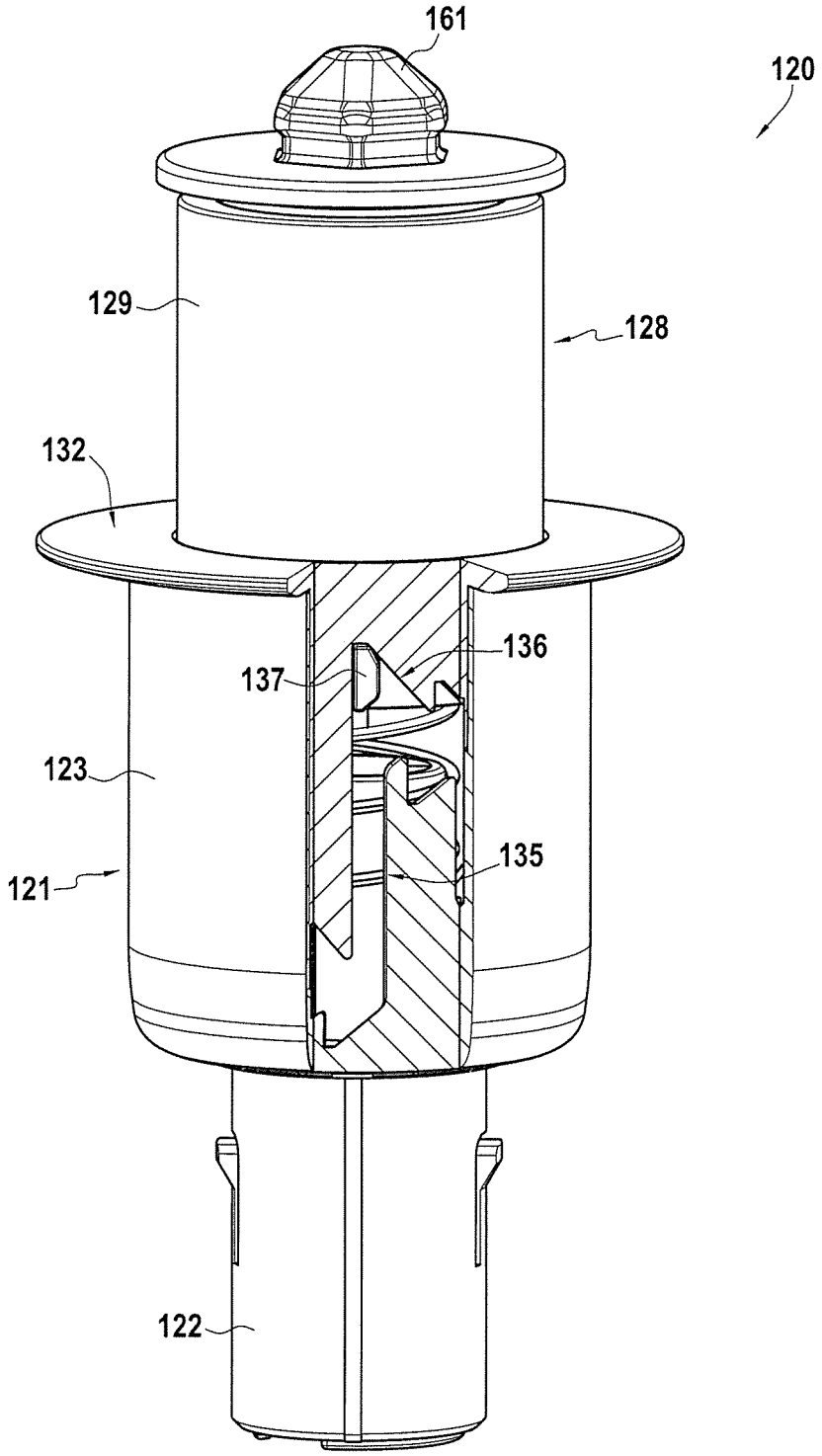
FIG. 21 is a perspective view of the elevation device in its upper position.

In fact, as is shown in FIG. 21, when the pins 137 are in their stable upper position 138*b*, the follower cylinder 128, and therefore the connecting stud 161, are encouraged to rise to project around 4 cm on the level of the plate 160.

In such a position, the mop 93 of the brush 90 has no more contact with the plate 160 and accordingly with the water present on the surface of the latter. The brush 90 can be wrung out by centrifuge and continuing to actuate the device for driving in rotation.

This time the only out-and-back movements necessary for wringing no longer have sufficient amplitude, without voluntary action by the user, to allow a move to the stable position following which a stable lower position 138*a* is located around 4 cm lower: the pins 137 describe out-and-back movements in the vertical channel 139 located in the axis of the stable upper position 138*b*. Therefore, it is possible to actuate the device for driving in rotation for as long as necessary to obtain the preferred level of wringing and remain in the upper position.

During this wringing, the wastewater discharged by the mop 93 flows around the plate 160, falls to the bottom of the bucket 108 and is collected in the first tank 141 intended for wastewater.

Also, when the connecting stud 161 is located in the upper position, its locking finger 163 disengages from the upper cavity 124*c* of the column 124 of the transmission piece 121. Therefore, the transmission piece 121 and the Archimedes screw 115 are no longer being driven, which halts the pumping device 110 and therefore the rise of clean water.

Once wringing is complete, it is possible either to exert sufficient descending force on the brush 90 to reach the first stable lower position 138*a* and recommence a rinsing cycle, or detach the brush 90 to clean the floor. To recommence a rinsing and wringing cycle, the brush 90 needs to be reattached to the connecting stud 161, the effort necessary for this connection sufficient to reach the first stable lower position 138*a*.

Even though the present invention has been described in reference to specific embodiments, it is evident that modifications and changes can be made in these examples without departing from general scope of the invention such as defined by the claims. In particular, individual features of the different embodiments illustrated/mentioned can be combined in additional embodiments. Consequently, the description and the drawings must be considered in an illustrative rather than restrictive sense.

It is also evident that all the features described in reference to a method are transposable, singly or in combination, to a device, and inversely all the features described in reference to a device are transposable, singly or in combination, to a method.

The invention claimed is:

1. A rinsing device for a cleaning device, comprising:

a first tank provided to collect wastewater coming from the cleaning device;

a second tank provided to store clean water;

a mechanical pumping device, configured to pump clean water coming from the second tank to wet the cleaning device; and one or more branches extending radially from and rotatably disposed about the pumping device, the one or more branches being rotatable about the pumping device between a blocking position and a clearance position, wherein in the blocking position the one or more branches cover at least one discharge nozzle, and wherein in the clearance position the one or more branches do not cover the at least one discharge nozzle.

2. The rinsing device according to claim 1, wherein the pumping device is configured to pump clean water when an activating member of the pumping device is driven in rotation.

3. The rinsing device according to claim 2, wherein the pumping device is configured to pump clean water when the activating member of the pumping device is driven in rotation by the cleaning device.

4. The rinsing device according to claim 3, wherein the pumping device is of compression type.

5. The rinsing device according to claim 1, wherein the pumping device is of compression type.

6. The rinsing device according to claim 1, wherein the pumping device is configured to pump clean water when the cleaning device exerts pressure on an activating member of the pumping device.

7. The rinsing device according to claim 6, wherein the pumping device comprises a compression chamber, a piston movable in the compression chamber between a rest position and a compression position, and a valve connecting the compression chamber to a discharge conduit.

8. The rinsing device according to claim 1, wherein the pumping device comprises a compression chamber, a piston movable in the compression chamber between a rest position and a compression position, and a valve connecting the compression chamber to a discharge conduit.

9. The rinsing device according to claim 8, further comprising a plate mounted about the piston, wherein the plate rotates about the piston between the rest position and the compression position.

10. The rinsing device according to claim 9, wherein the plate comprises at least one row of brush hairs configured to move about the cleaning device.

11. The rinsing device according to claim 9, further comprising a bucket that comprises:

a base wall; and an external circular wall delimiting an internal volume of the bucket, wherein the base wall and the external circular wall define the first tank, wherein the plate mounted about the piston is offset from the external circular wall.

12. The rinsing device according to claim 9, further comprising a connecting stud disposed adjacent to the plate and configured to receive a connecting cavity from the cleaning device.

13. The rinsing device according to claim 1, comprising a plate provided to receive the cleaning device, and wherein the pumping device is configured to have clean water flow along the plate.

14. The rinsing device according to claim 13, wherein the plate comprises a plurality of nozzles connected to the pumping device.

15. An assembly comprising the cleaning device and the rinsing device according to claim 1.

16. The assembly according to claim 15, wherein the cleaning device comprises at least one wringing device.

17. The assembly according to claim 16, wherein the at least one wringing device of the cleaning device is of centrifuge type.

18. The rinsing device according to claim 1, further comprising a funnel extending from the second tank.

19. A rinsing device, comprising:

a bucket;

a pumping device coupled to the bucket, wherein the pumping device comprises a compression chamber, a piston movable in the compression chamber between a rest position and a compression position, and a valve connecting the compression chamber to a discharge conduit;

a first tank defined by the bucket, wherein the first tank is provided to collect wastewater coming from a cleaning device;

one or more branches extending radially from and rotatably disposed about the pumping device and configured to rotate about the pumping device between a blocking position and a clearance position, wherein in the blocking position the one or more branches operably cover the discharge conduit, and wherein in the clearance position the one or more branches do not cover the discharge conduit;

a second tank disposed within the bucket about the pumping device; and a plate coupled to the pumping device and configured to rotate.

20. A rinsing device, comprising:

a base wall;

an external circular wall, wherein the base wall and the external circular wall define a first tank;

a mechanical pumping device coupled to the base wall, wherein the pumping device comprises a compression chamber, a piston movable in the compression chamber between a rest position and a compression position, and a valve connecting the compression chamber to a discharge conduit;

a plate coupled to the pumping device, wherein the discharge conduit is disposed on the plate; and one or more branches extending radially from and rotatably disposed about the pumping device, the one or more branches being configurable to rotate about the pumping device between a blocking position and a clearance position, wherein in the blocking position the one or more branches cover the discharge conduit, and wherein in the clearance position the one or more branches do not cover the discharge conduit.

* * * * *